US007101316B2

(12) United States Patent
Rosenow et al.

(10) Patent No.: US 7,101,316 B2
(45) Date of Patent: Sep. 5, 2006

(54) ELLIPTICAL STEP EXERCISE APPARATUS

(75) Inventors: Charles J. Rosenow, Ramsey, MN (US); Cilfford F. Mueller, Crystal River, FL (US); Bradley H. Grossman, Champlin, MN (US); John J. Hsing, Chicago, IL (US); John M. Rogus, Skokie, IL (US)

(73) Assignee: Brunswick Corporation, Lake Forest, IL (US)

( * ) Notice: Subject to any disclaimer, the term of this patent is extended or adjusted under 35 U.S.C. 154(b) by 14 days.

(21) Appl. No.: 10/966,275

(22) Filed: Oct. 15, 2004

(65) Prior Publication Data

US 2005/0049118 A1 Mar. 3, 2005

Related U.S. Application Data

(60) Division of application No. 09/835,672, filed on Apr. 16, 2001, now Pat. No. 6,846,272, which is a continuation-in-part of application No. 09/332,860, filed on Jun. 15, 1999, now Pat. No. 6,217,486.

(51) Int. Cl.
*A63B 22/00* (2006.01)

(52) U.S. Cl. ..... 482/52; 482/57; 482/70

(58) Field of Classification Search ..... 482/51, 482/52, 57, 70, 79–80, 148
See application file for complete search history.

(56) References Cited

U.S. PATENT DOCUMENTS

| | | | | |
|---|---|---|---|---|
| 4,509,742 | A * | 4/1985 | Cones | 482/58 |
| 5,242,343 | A * | 9/1993 | Miller | 482/57 |
| 5,876,307 | A * | 3/1999 | Stearns et al. | 482/51 |
| 6,152,859 | A * | 11/2000 | Stearns | 482/52 |
| 6,485,395 | B1 * | 11/2002 | Stearns et al. | 482/57 |

* cited by examiner

*Primary Examiner*—Stephen R. Crow
(74) *Attorney, Agent, or Firm*—Michael B. McMurry

(57) ABSTRACT

In an exercise apparatus having a frame that is adapted for placement on the floor, a pivot axle supported by the frame, a pair of pedal levers, pedals secured to the pedal levers, arm handles connected for motion with the pedal levers and which can utilize a variety of pedal actuation assemblies for generating elliptical motion of the pedal, the stride length portion of the elliptical motion can be increased automatically as a function of exercise parameters such as speed. In addition, the arm handles can be disconnected manually or automatically from the pedal levers.

14 Claims, 26 Drawing Sheets

ELLIPTICAL STEP EXERCISE APPARATUS

CROSS-REFERENCE TO RELATED APPLICATION

This application is a divisional application of Ser. No. 09/835,672, filed Apr. 16, 2001, now U.S. Pat. No. 6,846,272; which in turn is a continuation in part of application Ser. No. 09/332,860, filed Jun. 15, 1999, now U.S. Pat. No. 6,217,486.

FIELD OF THE INVENTION

This invention relates generally to exercise equipment and more particularly to exercise equipment which can be used to provide a user with an elliptical step exercise.

BACKGROUND OF THE INVENTION

There are a number of different types of exercise apparatus that exercise a user's lower body by providing a circuitous stepping motion. These elliptical stepping apparatus provide advantages over other types of exercise apparatuses. For example, the elliptical stepping motion generally reduces shock on the users knees as can occur when a treadmill is used. In addition, elliptical stepping apparatuses exercise the user's lower body to a greater extent than, for example, cycling-type exercise apparatuses. Examples of elliptical stepping apparatuses are shown in U.S. Pat. Nos. 3,316,898; 5,242,343; 5,383,829; 5,499,956; 5,529,555, 5,685,804; 5,743,834, 5,759,136; 5,762,588; 5,779,599; 5,577,985, 5,792,026; 5,895,339, 5,899,833, 6,027,431, 6,099,439, 6,146,313, and German Patent No. DE 2 919 494.

However, these elliptical stepping exercise apparatus and other suffer from various drawbacks. For example, some apparatuses are limited to exercising the user's lower body and do not provide exercise for the user's upper body. In addition, the elliptical stepping motion of some apparatus do not produce an optimum foot motion including heel to toe flexure or optimal stride length for different individuals during operation of the apparatus. For example, the elliptical step machines shown in U.S. Pat. Nos. 5,743,835 and 6,027,431 rely on the user to adjust stride length during operation of the machine to obtain a comfortable stride.

Also, for those elliptical step machines that include arm handles connected for motion with the foot pedals to provide upper body exercise, the range of motion of the arm handle in many instances does not provide for a comfortable upper body exercise nor provide a mechanism that would permit the user to readily disconnecting the arm handles from the pedals when upper body exercise is not desired.

SUMMARY OF THE INVENTION

It is therefore an object of the invention to provide an elliptical stepping exercise apparatus that provides an improved elliptical step exercise regime.

Another object of the invention is to provide a stepping exercise apparatus that simulates a natural foot motion where the length of the user's stride is automatically adjusted according to certain operating parameters such as pedal speed thereby promoting exercise efficiency. For example, in a machine where pedal lever are used to support the pedals, the pedal levers are attached to a rotating crank by a direct attachment or an actuation assembly to provide an elliptical motion to the pedals, the crank or an element of the attachment assembly can be changed by an actuator as a function of pedal speed in order to increase the stride length as pedal speed increases.

A further object of the invention is to provide an elliptical stepping apparatus that provides for upper body exercise utilizing arm handles connected to rockers which in turn are connected to the pedal levers where the arm handles can be disconnected from the pedal levers by the user. In one embodiment of the invention for example where one end of the pedal lever is connected to the frame by a rocker link mounted for rotation on a shaft secured to the frame, the arm handle is attached to a connector tube mounted for rotation on the shaft and the tube is selectively engaged with the rocker link or a restraining hub on the frame. This engagement process can be implemented by either a manually or motor driven worm gear or alternatively by a linear actuator that moves the tube linearly on the shaft.

These and other objectives and advantages are provided by the present invention which is directed to an exercise apparatus that can be employed by a user to exercise the user's upper and lower body.

BRIEF DESCRIPTION OF THE DRAWINGS

In the drawings which illustrate the best modes presently contemplated for carrying out the invention.

DETAILED DESCRIPTION

Figure 1:
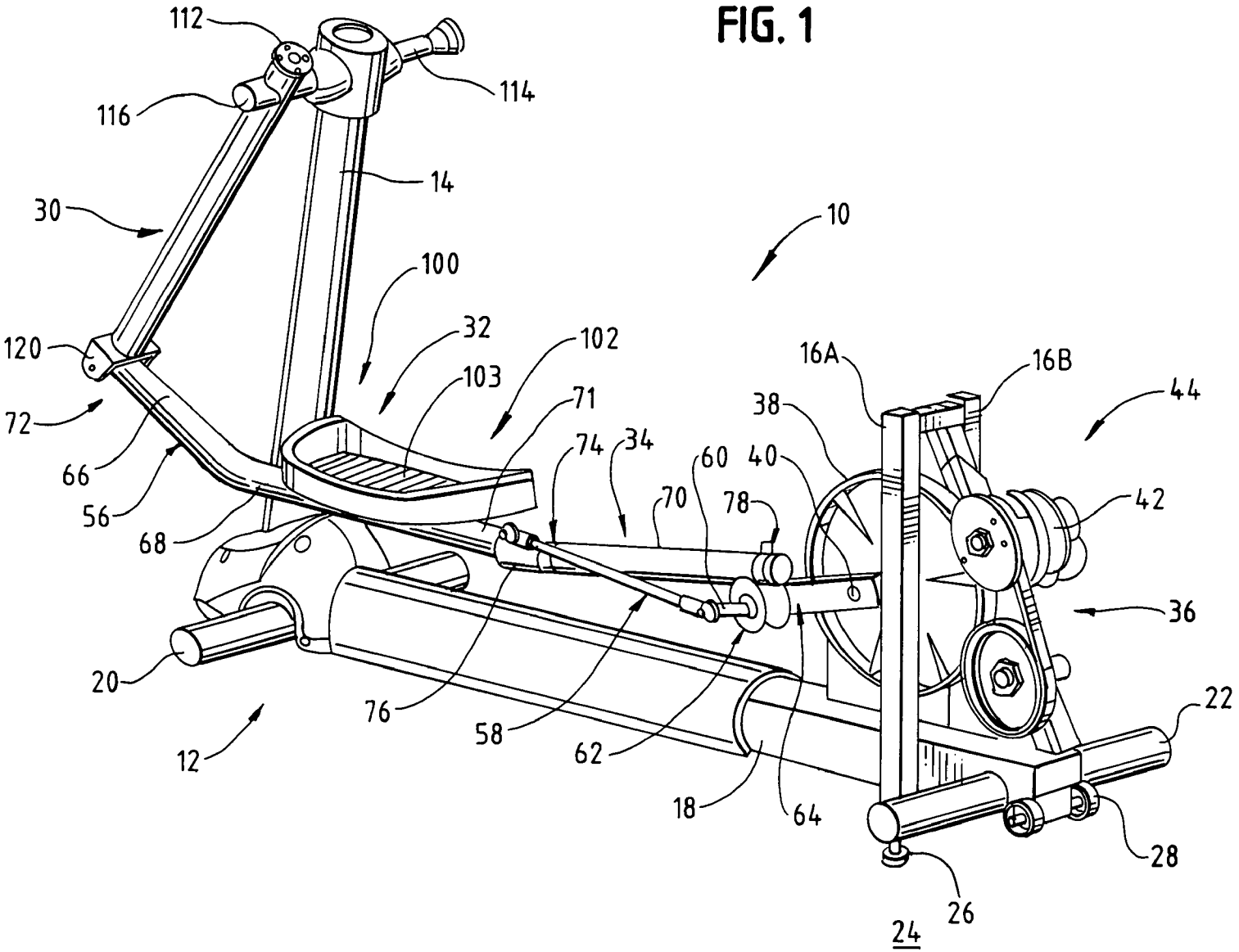
FIG. 1 is a partially cut-away side perspective view of the preferred embodiment of an exercise apparatus according to the invention.

I. Overview of Mechanical Aspects of the Invention

A primary objective of the present invention is to provide a mechanically simple elliptical stepping exercise apparatus in which the pedal follows a substantially elliptical pathway in such a manner so as to simulate the natural foot weight distribution, and optimal foot motion and flexure associated with a natural walking or running gait while at the same time providing a synchronized mechanism for upper body exercise. The present invention implements numerous different pedal actuation assemblies for providing this more natural foot motion. In addition, each of these pedal actuation assemblies can be connected to an arm handle assembly to provide an upper body workout.

This invention is thus directed to numerous general embodiments of an exercise apparatus in which the foot pedal follows a substantially elliptical pathway and moves in a manner that simulates a natural weight distribution, and a natural foot motion and flexure of a foot associated with the normal human walking or running gait. It should be understood, however, that the mechanisms as described can be modified within the scope of the invention to produce other types of foot motion. A first general embodiment, which is the preferred embodiment of the invention, is discussed with reference to FIGS. 1–6. A second general embodiment is discussed with reference to FIG. 7. A third general embodiment is discussed with reference to FIGS. 8 and 9. A fourth general embodiment is discussed with reference to FIG. 10. A fifth general embodiment is discussed with reference to FIGS. 11 and 12. A sixth general embodiment is discussed with reference to FIG. 13. A seventh general embodiment is discussed with reference to FIG. 14.

In addition, two embodiments of arm handle disconnect mechanisms are discussed in connection with FIGS. 17–19 and in connection with the diagrams in FIGS. 15–16. Further, five embodiments of pedal actuation assemblies for varying stride length are discussed in connection with FIGS. 20–24 and in connection with the diagrams of FIGS. 15–16.

Through all of the various embodiments and Figures, like reference numbers denote like components. In addition, the pedaling mechanism of the invention is symmetrical and includes a left portion and a right portion. The following detailed description of all of the various embodiments is directed to the components of the left portion although it is to be understood that the right portion includes like components that operate in a like fashion.

II. Detailed Description of the First General Embodiment

Referring now to the drawings in which like reference numerals designate like or corresponding parts throughout the several views, there is shown in FIGS. 1–6 the first general embodiment, which is the preferred embodiment of an exercise apparatus incorporating the unique features in accordance with the present invention which is designated generally by the reference numeral 10.

The exercise apparatus 10, as well as all of the various embodiments further described herein, include motion controlling components which operate in conjunction with the various pedal actuation assemblies and motion generating components to provide a pleasurable exercise experience for the user.

As illustrated in FIGS. 1–4, the exercise apparatus 10 includes a frame, shown generally at 12. The frame 12 includes vertical support members 14, 16A and 16B which are secured to a longitudinal support member 18. The frame 12 further includes cross members 20 and 22 which are also secured to and bisect the longitudinal support member 18. The cross members 20 and 22 are configured for placement on a floor 24. A pair of levelers 26 are secured to cross member 22 so that if the floor 24 is uneven, the cross member 22 can be raised or lowered such that the cross member 22, and the longitudinal support member 18 are substantially level. Additionally, a pair of wheels 28 are secured to the longitudinal support member 18 of the frame 12 at the rear of the exercise apparatus 10 so that the exercise apparatus 10 is easily moveable.

Figure 2:
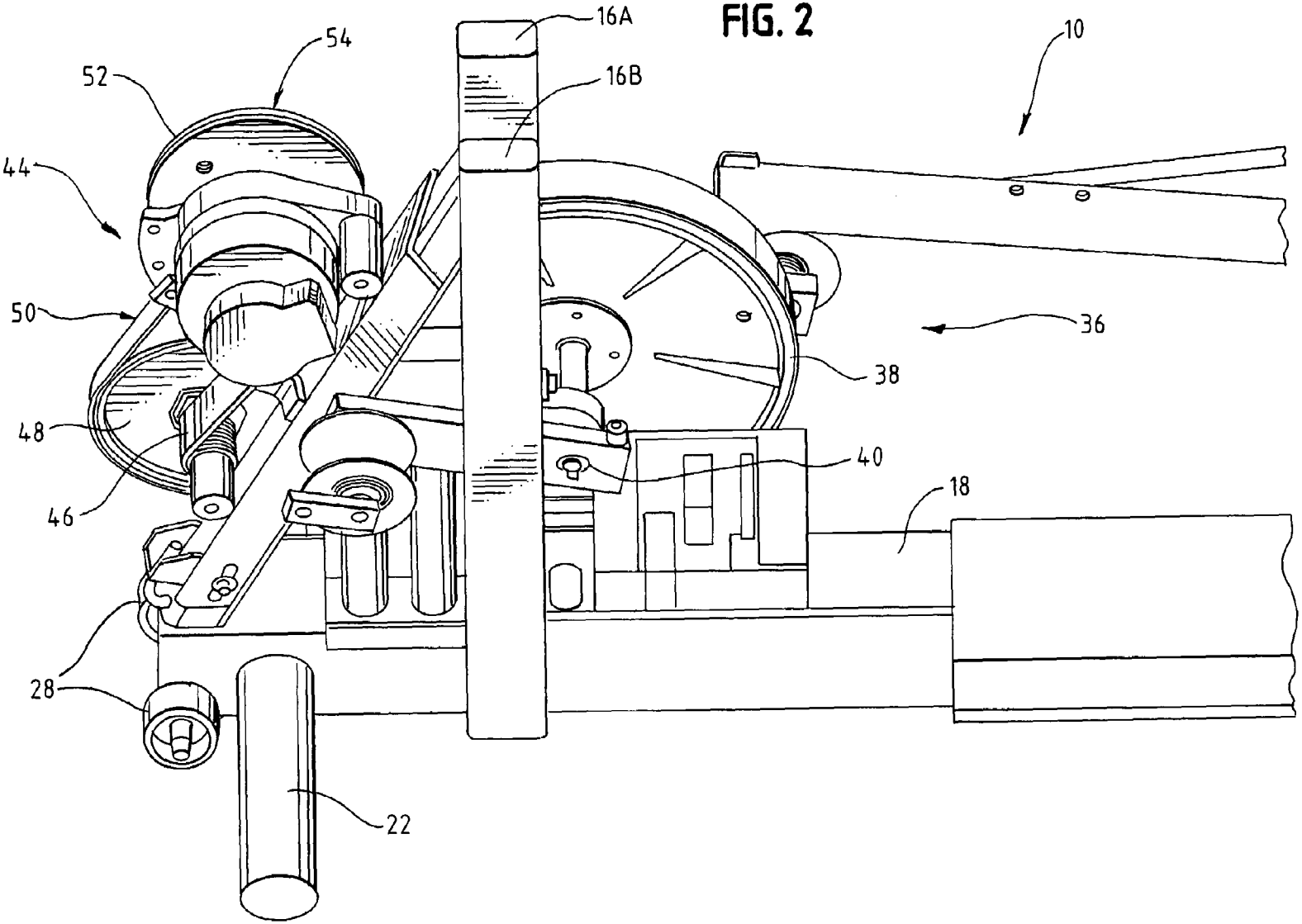
FIG. 2 is a partially cut-away top perspective view of the exercise apparatus in FIG. 1 showing the pulley, flywheel, alternator and transmission.
Figure 3:
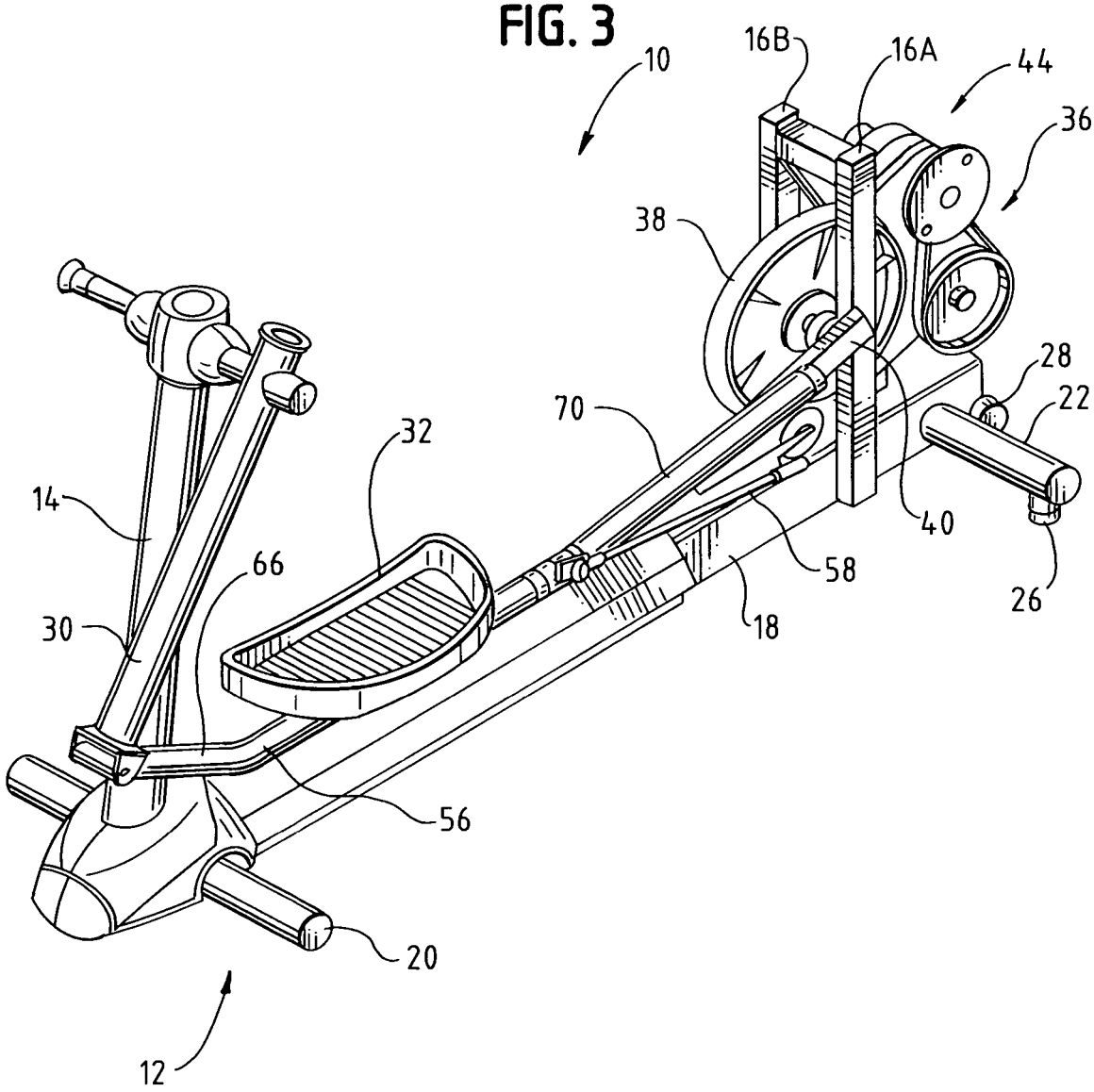
FIG. 3 is a partial cut-away top perspective view of the exercise apparatus in FIG. 1.
Figure 4:
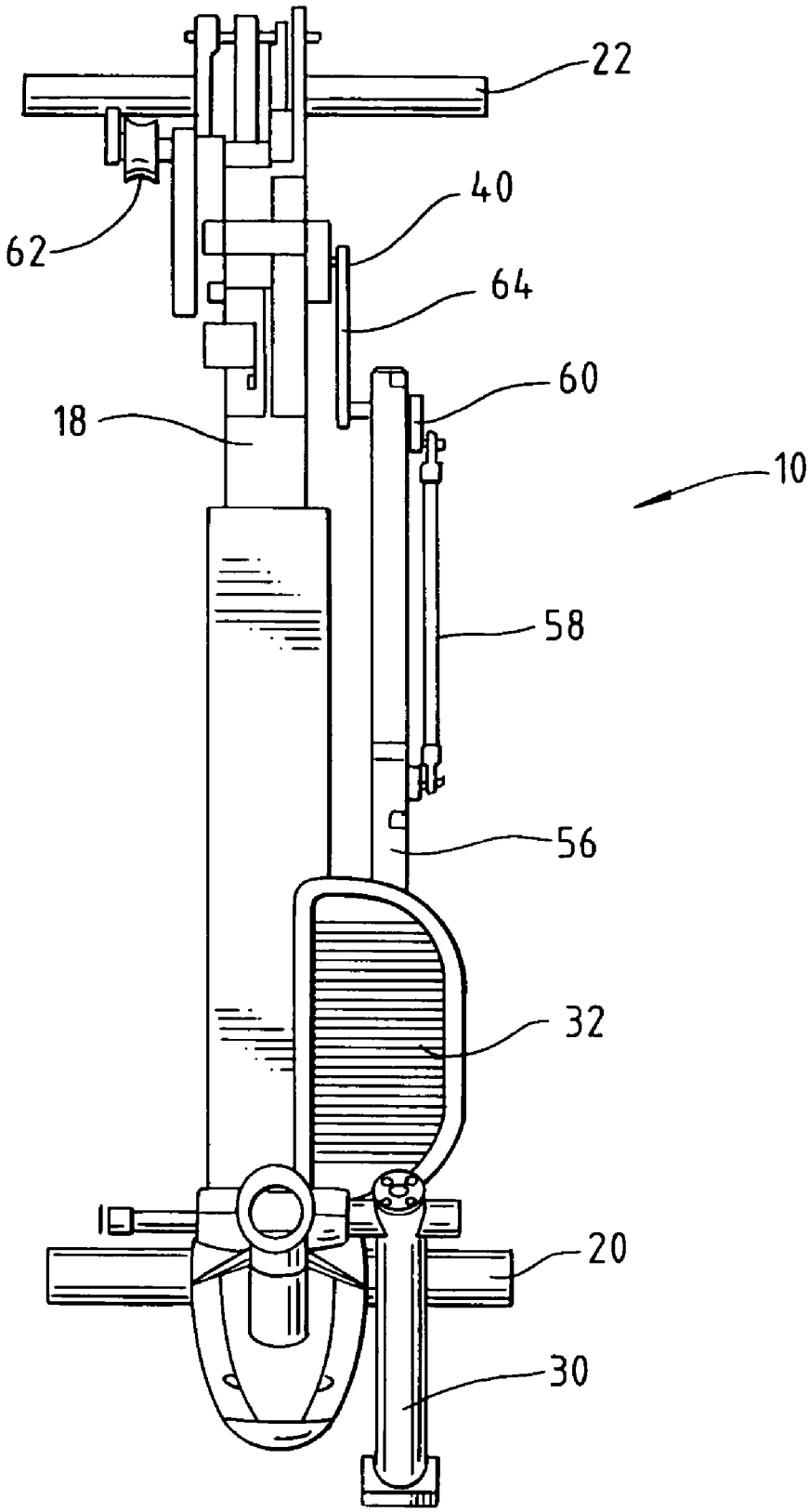
FIG. 4 is a partial cut-away top view of the exercise apparatus in FIG. 1.

The exercise apparatus 10 further includes a rocker 30, a pedal 32, a pedal actuation assembly 34 and a motion controlling assembly 36. As more fully illustrated in FIG. 2, the motion controlling assembly 36 includes a pulley 38 supported by vertical support members 16A and 16B around a pivot axle 40. The motion controlling assembly 36 also includes resistive force and control components, including an alternator 42 and a speed increasing transmission 44 that includes the pulley 38. The alternator 42 provides a resistive torque that is transmitted to the pedal 32 and to the rocker 30 through the speed increasing transmission 44. The alternator 42 thus acts as a brake to apply a controllable resistive force to the movement of the pedal 32 and the movement of the rocker 30. Alternatively, a resistive force can be provided by any suitable component, for example, by an eddy current brake, a friction brake, a band brake or a hydraulic braking system. Specifically, as best seen in FIG. 2, the speed increasing transmission 44 includes the pulley 38 which is coupled by a first belt 46 to a second double pulley 48. A second belt 50 connects the second double pulley 48 to a third pulley 52 that in turn is attached to a flywheel 54 of the alternator 42. The speed increasing transmission 44 thereby transmits the resistive force provided by the alternator 42 to the pedal 32 and the rocker 30 via the pulley 38. Since the speed increasing transmission 44 causes the alternator 42 to rotate at a greater rate than the pivot axle 40, the alternator 42 can provide a more controlled resistance force. Preferably the speed increasing transmission should increase the rate of rotation of the alternator 42 by a factor of 20 to 60 times the rate of rotation of the pivot axle 40 and in the preferred embodiment the pulleys 38 and 48 are sized to provide a multiplication in speed by a factor of 40. Also, size of the transmission 44 is reduced by providing a two stage transmission using pulleys 38 and 48 is used.

Figure 5:
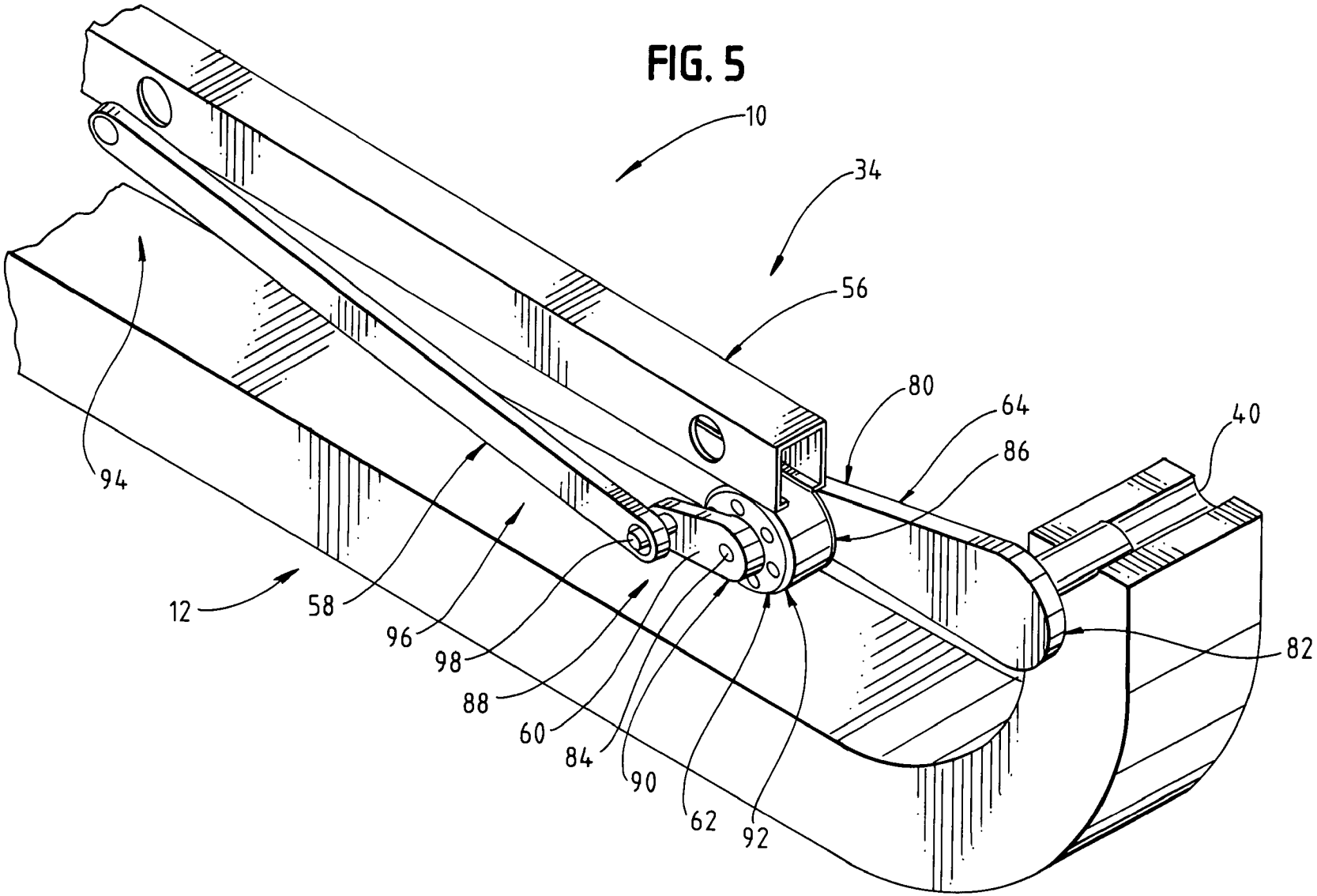
FIG. 5 is a partial simplified side perspective view of the stroke link, roller, pedal lever and double offset crank assembly of the exercise apparatus in FIG. 1.

As illustrated in FIGS. 1 and 5, the pedal actuation assembly 34 includes a pedal lever 56, a stroke link 58, an extension arm 60, a roller 62 and a crank 64. The pedal lever 56 is bent and includes a first portion 66, a second portion 68 and a third portion 70. The first portion 66 of the pedal lever 56 has a forward end 72. The first portion 66 of the pedal lever 56 is approximately 11 inches in length and upwardly extends from the second portion 68 at an angle of approximately 25°. The second portion 68 of the pedal lever 56 has a top surface 71 and a rearward end 74. The second portion 68 of the pedal lever 56 is approximately 26 inches in length. The pedal 32 is secured to the top surface 71 of the second portion 68 of the pedal lever 56 by any suitable securing means. In the preferred embodiment, the pedal 32 is secured such that the pedal 32 is substantially parallel to the second portion of the pedal lever 68. A bracket 76 is located at the rearward end 74 of the second portion 68 approximately 6 ¾ inches from the pedal 32. The third portion 70 of the pedal lever 56 has a rearward end 78. The third portion 70 of the pedal lever 56 is approximately 19 ½ inches in length and upwardly extends from the second portion 68 at an angle of approximately 9°. The bent pedal lever 56 allows a user to more easily mount the exercise apparatus 10.

Continuing, as illustrated in FIGS. 1 and 5, the crank 64 includes a forward end 80 and a rearward end 82. The rearward end 82 of the crank 64 is connected to and rotates about the pivot axle 40. A roller axle 84 is secured to the forward end 80 of the crank 64 to rotatably mount the roller 62 so that it can rotate about the roller axle 84. The extension arm 60 includes a forward end 88 and a rearward end 90. The rearward end 90 of the extension arm 60 is secured to and rotates about an outer surface 92 of the roller 62 about the roller axle 84. The stroke link 58 includes a forward end 94 and a rearward end 96. The rearward end 96 of the stroke link 58 is pivotally connected to the forward end 88 of the extension arm 60 at a pivot point 98 by any suitable connecting means. Moreover, the forward end 94 of the stroke link 58 is pivotally connected to the bracket 76 by any suitable connecting means.

The pedal 32 of the exercise apparatus 10 includes a toe portion 100 and a heel portion 102 so that the heel portion 102 is intermediate the toe portion 100 and the pivot axle 40. The pedal 32 of the exercise apparatus 10 also includes a top surface 103. As explained in more detail below, in reference to FIG. 6, the pedal 32 is secured to the top surface 71 of the pedal lever 56 in a manner so that the desired foot weight distribution and flexure are achieved when the pedal 32 travels in a substantially elliptical pathway 104 (shown in FIG. 6) as the rearward end 78 of the third portion 70 of the pedal lever 56 rolls on top of the roller 62, travelling in a rotationally arcuate pathway with respect to the pivot axle 40 and in the preferred embodiment moves in an elliptical pathway 106 (shown in FIG. 6) around the pivot axle 40. Since the rearward end 78 of the pedal lever 56 is not maintained at a predetermined distance from the pivot axis 40 but instead follows the elliptical pathway 106, a more refined foot motion is achieved. In the preferred embodiment, the rearward end 78 of the third portion 70 of the pedal lever 56 can move in two ways in the elliptical pathway 106 around the pivot axle 40. First, the rearward end 78 of the third portion 70 of the pedal lever 56 can move counterclockwise in the elliptical pathway 106, as seen from the user's left side. When the rearward end 78 of the third portion 70 of the pedal lever 56 travels counterclockwise in the elliptical pathway 106, the pedal 32 travels in a direction along the elliptical pathway 104 that simulates a forward-stepping motion. In the forward-stepping mode, as the pedal 32 moves in the elliptical pathway 104, the heel portion 102 is lowered below the toe portion 100 when the forward end 72 of the first portion 66 of the pedal lever 56 moves in a reciprocating arcuate pathway 108 in a direction towards the pivot axle 40. Second, the rearward end 78 of the third portion 70 of the pedal lever 56 can move clockwise in the elliptical pathway 106, as seen from the user's left side. When the rearward end 78 of the third portion 70 of the pedal lever 56 travels clockwise in the elliptical pathway 106, the pedal 32 travels in a direction along the elliptical pathway 104 that simulates a backward-stepping motion. In the backward-stepping mode, as the pedal 32 moves in the elliptical pathway 104, the heel portion 102 of the pedal 32 is raised above the toe portion 100 of the pedal 32 when the forward end 72 of the first portion 66 of the pedal lever 56 moves in the reciprocating arcuate pathway 108 in a direction towards the pivot axle 40.

In the preferred embodiment, the exercise apparatus 10 also includes an upper handle 110 as shown in FIGS. 6A–6H. The upper handle 110 is rigidly attached to an upper portion 112 of the rocker 30. The upper portion 112 of the rocker 30 is pivotally attached to an axle 114 at a pivot point or hub 116. The axle 114 bisects and is connected to the vertical support member 14 of the frame 12. A lower portion 118 of the rocker 30 is pivotally connected to the forward end 72 of the first portion 66 of the pedal lever 56 at a pivot point 120.

During operation, the rocker 30 swings forward and aft, causing the forward end 72 of the first portion 66 of the pedal lever 56 to travel forward and aft along the reciprocating pathway 108. As the upper handle 110 moves, as indicated by a line 121, toward the rearward end 78 of the third portion 70 of the pedal lever 56, the rearward end 78 of the third portion 70 of the pedal lever 56 moves in the elliptical pathway 106 towards the pivot axle 40. In the reverse direction, as the rearward end 78 of the third portion 70 of the pedal lever 56 moves away from the pivot axle 40, the upper handle 110 moves towards the pivot axle 40. In the preferred embodiment, the upper handle includes a hand grip 122 portion that extends from the upper handle 110 at a predetermined angle which is selected to promote ergonomic efficiency. It has also been found that the arm motion feels best when the rocker 30 and the upper handle 110 are approximately the same length. More particularly, the most desirable feel to the user results when the range of motion of the rocker 30 at pivot point 120 is approximately equal to the range of motion of the portion of the arm handle 110 having the hand grip 122. By using the pedal lever 56 having a bent first portion 66, it is possible to size the rocker 30 so as to provide optimum upper arm movement. For example, if the pedal lever 56 were straight, without changing the length of the rocker 30 or the upper handle 110, the user would tend to grasp the upper handle 110 at a point higher up which would result in a range of arm motion that would be too great. Similarly, if the pedal lever 56 were straight, and the length of the rocker 30 were to be increased, the user could grasp the upper handle 110 at the same point 122 as the apparatus 10 shown in FIGS. 1–6, but this would result in an undesirable decrease in the range of arm motion. It will also be appreciated that the stroke link 58 primarily controls the horizontal movement of the pedal lever 56. The geometry of the pedal actuation assembly 34 is such that the horizontal movement of the pedal lever 56 is greater than the vertical movement and preferably, the rocker 56 and upper handle are approximately equal so as to provide the optimum foot and arm motion.

The contributions of the components of the pedal actuation assembly 34 to the desired elliptical motion are now explained generally with reference to FIG. 6. As the pulley 38 rotates about the pivot axle 40, the rearward end 78 of the third portion 70 of the pedal lever 56 moves in the generally elliptical pathway 106 due to the coupling between the pivot axle 40, the crank 64, the roller 62 and the rearward end 78 of the third portion 70 of the pedal lever 56. The forward end 72 of the first portion 66 of the pedal lever 56, however, is constrained to move in the arcuate pathway 108, due to the pivotal connection between the forward end 72 of the first portion 66 of the pedal lever 56 and the rocker 30. Consequently, as the rearward end 78 of the third portion 70 of the pedal lever 56 moves in the elliptical pathway 106, the forward end 72 of the first portion 66 of the pedal lever 56 moves in the reciprocating arcuate pathway 108. The translation from the elliptical motion of the rearward end 78 of the third portion 70 of the pedal lever 56 to the reciprocating arcuate motion of the forward end 72 of the first portion 66 of the pedal lever 56 provides a substantially elliptical motion intermediate the rearward end 78 of the third portion 70 of the pedal lever 56 and the forward end 72 of the first portion 66 of the pedal lever 56. Consequently, the pedal 32, which is coupled to the top surface 71 of the pedal lever 56 intermediate the rearward end 78 of the third portion 70 of the pedal lever 56 and the forward end 72 of the first portion 66 of the pedal lever 56 moves in the substantially elliptical pathway 104 as shown in FIG. 6. The horizontal dimension of the elliptical pathway 104 is determined by the major diameter of the elliptical pathway 106. The vertical dimension of the elliptical pathway 104 is determined by the exact location of the pedal 32 on the pedal lever 56, and the minor diameter of the elliptical pathway 106. Specifically, the motion of the pedal 32 approaches a more elliptical motion the closer the pedal 32 is to the third portion 70 of the pedal lever 56 and the motion of the pedal 32 approaches a more arcuate motion the closer the pedal 32 is to the first portion 66 of the pedal lever 56. Consequently, the height of the elliptical pathway 104 can be changed by changing the location of the pedal 32 along the top surface 71 of the pedal lever 56.

The movement of the pedal 32, which is determined by the components of the pedal actuation assembly 34, is now discussed in detail with reference to the simplified functional schematic drawings labeled as FIGS. 6A–6H. FIGS. 6A–6H trace the motion of the pedal 32 as the pedal 32 completes one forward-stepping revolution along the elliptical pathway 104, beginning at the rearmost position of the reciprocating arcuate pathway 108 of the first portion 66 of the pedal lever 56. As previously stated, the exercise apparatus 10 can be operated both in a forward-stepping mode and in a backward-stepping mode. When the exercise apparatus 10 is operated in the forward-stepping mode, the pedal 32 travels in a counterclockwise sequence as illustrated in FIGS. 6A–6H. Alternatively, when the exercise apparatus 10 is operated in the backward-stepping mode, the sequence of the pedal 32 is reversed so that the pedal 32 moves from the starting point, shown in FIG. 6A, in a clockwise direction to the position shown in FIG. 6H.

Figure 6A:
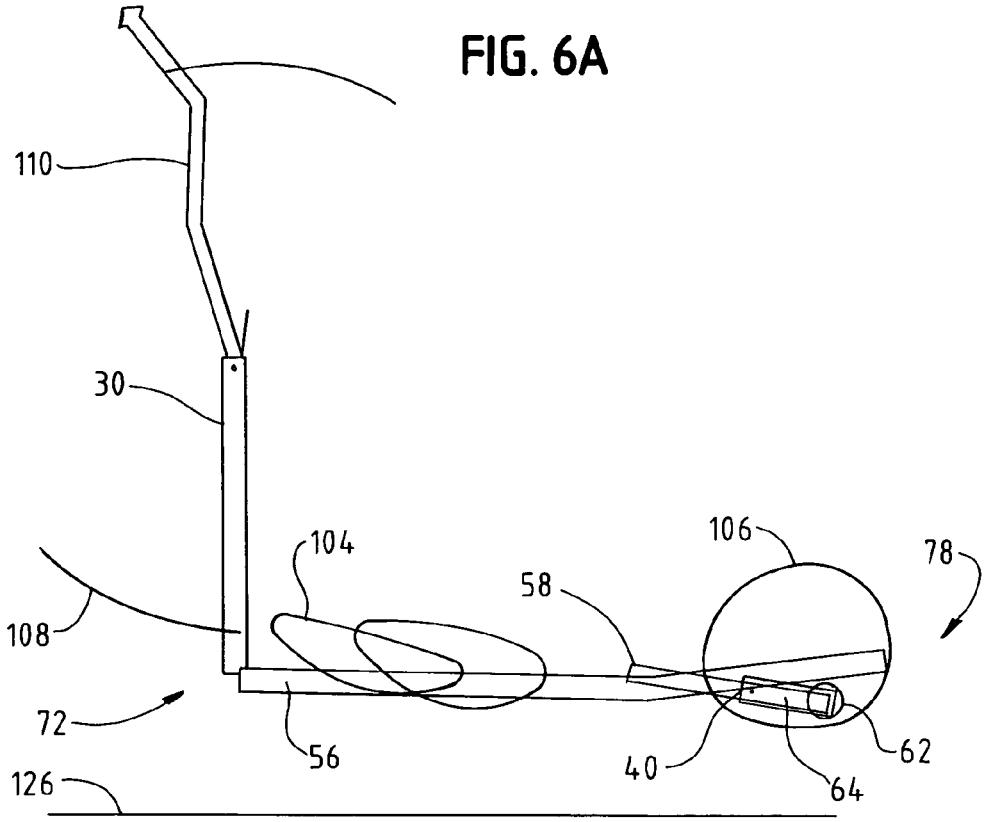
FIGS. 6A–6H are simplified functional schematic representations of the reciprocating movement of the second end of the pedal lever and illustrations of the elliptical pathway traced by the pedal as the second end of the pedal lever completes its elliptical reciprocating path of travel.

Beginning at FIG. 6A, the forward end 72 of the first portion 66 of the pedal lever 56 is at the rearmost position on the arcuate pathway 108. As noted previously, the rearward end 78 of the third portion 70 of the pedal lever 56 moves in the reciprocating elliptical pathway 106 as the forward end 72 of the first portion 66 of the pedal lever 56 moves in the reciprocating arcuate pathway 108. Consequently, the movement of the rearward portion 78 of the third portion 70 of the pedal lever 56 generates a varying angular displacement 124 between the pedal lever 56 and a fixed, horizontal reference plane 126. When the forward end 72 of the first portion 66 of the pedal lever 56 is at the rearmost position on the reciprocating arcuate pathway 108, the angular displacement 124 between the pedal lever 56 and the reference plane 126 is 5.7°. In addition, an angular displacement 128 between the top surface 103 of the pedal 32 and the horizontal reference plane 126 is 5.7° while an angle 130 between the top surface 103 of the pedal 32 and the top surface 71 of the pedal lever 56 is 0°. Moreover, a linear displacement 132 between a point 134 on the top surface 103 of the pedal 32 and the horizontal reference plane 126 is about 9.8 inches.

Figure 6B:
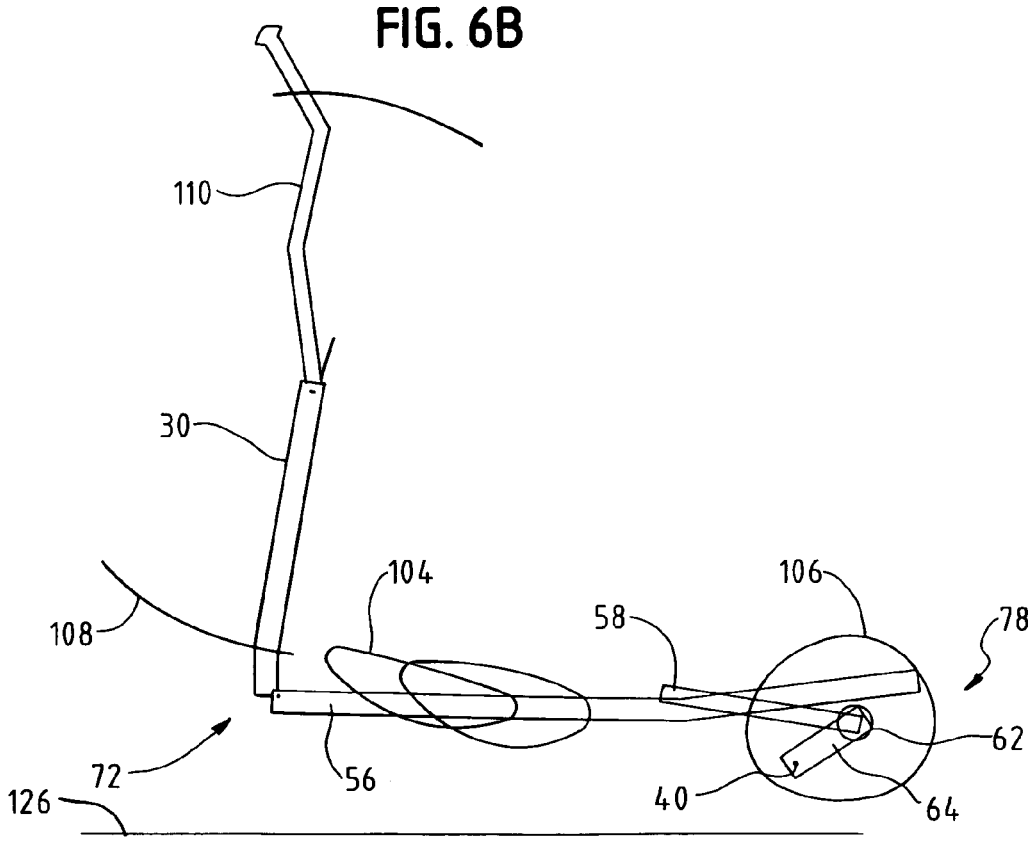

As the pedal 32 is moved by the user in the forward-stepping mode, rotation of the pulley 38 on the pivot axle 40 by about 45° moves the pedal 32 to the position shown in FIG. 6B. The forward end 72 of the first portion 66 of the pedal lever 56 has advanced about one-fourth of the distance along the reciprocating arcuate pathway 108 away from the pivot axle 40. At this point, the varying angular displacement 128 between the top surface 103 of the pedal 32 and the horizontal reference plane 126 is about 11.0° while the angle 130 between the top surface 103 of the pedal 32 and the top surface 71 of the pedal lever 56 remains 0°. In addition, the linear displacement 132 between the point 134 and the horizontal reference plane 126 has increased to about 11.5 inches while the angular displacement 124 between the pedal lever 56 and the horizontal reference plane 126 has increased to about 11.0°. This change in the angular displacement 128 also corresponds to a flexure of the foot in which the toe portion 100 of the pedal 32 is being raised above the heel portion 102 of the pedal 32. The weight distribution and flexure thus provided by the pedal actuation assembly 34 corresponds to that of the normal human gait.

Figure 6C:
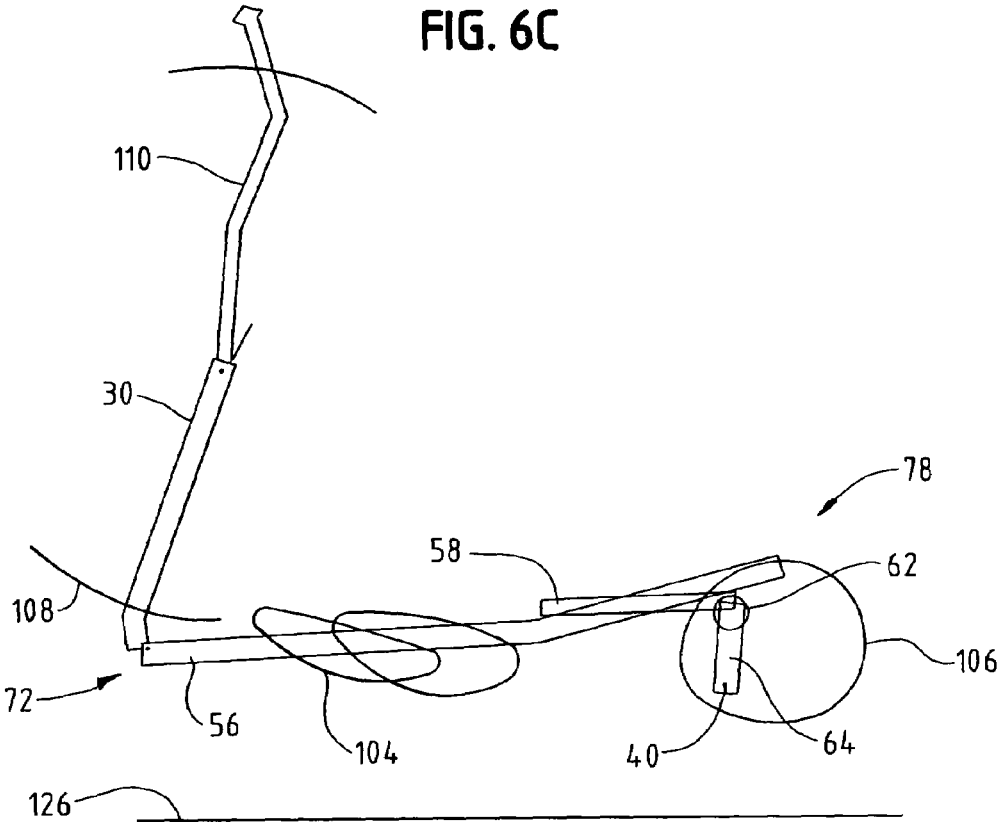

Forward rotation of the pulley 38 on the pivot axle 40 by about another 45° brings the pedal 32 to the position shown in FIG. 6C, at which point the forward end 72 of the first portion 66 of the pedal lever 56 has traveled about half-way along the reciprocating arcuate pathway 108 away from the pivot axle 40. At this point, the varying angular displacement 128 between the top surface 103 of the pedal 32 and the horizontal reference plane is about 12.3° while the angle 130 between the top surface 103 of the pedal 32 and the top surface 71 of the pedal lever 56 remains 0°. In addition, the linear displacement 132 between the point 134 and the horizontal reference plane 126 has increased to about 12.4 inches while the angular displacement 124 between the top surface 71 of the pedal lever 56 and the horizontal reference plane 126 has increased to about 12.3°. This change in the angular displacement 128 also corresponds to the flexure in which the toe portion 100 of the pedal 32 is being raised even higher than the heel portion 102 of the pedal 32 as would occur in a normal non-assisted forward-stepping gait.

Figure 6D:
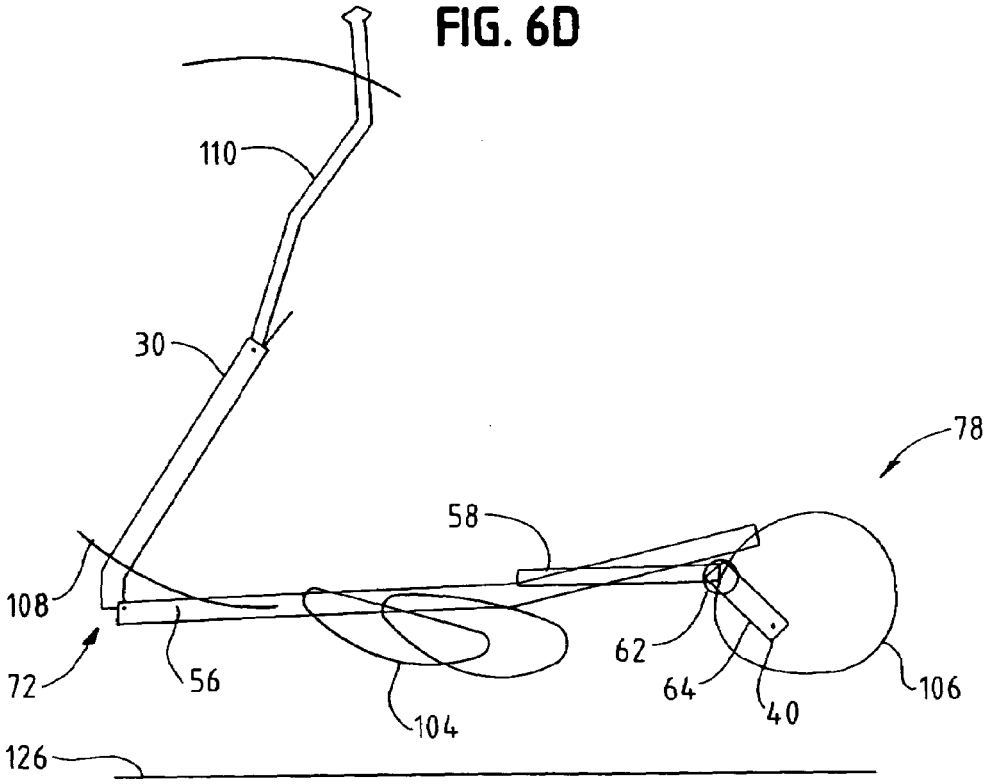

Forward rotation of the pulley 38 on the pivot axle 40 by about another 45° brings the pedal 32 to the position shown in FIG. 6D, at which point the forward end 72 of the first portion 66 of the pedal lever 56 has traveled about three-fourths the distance along the reciprocating arcuate pathway 108 away from the pivot axle 40. At this point, the varying angular displacement 128 between the top surface 103 of the pedal 32 and the horizontal reference plane 126 is about 7.1° while the angle 130 between the top surface 103 of the pedal 32 and the top surface 71 of the pedal lever 56 remains 0°. In addition, the linear displacement 132 between the point 134 and the horizontal reference plane 126 has increased to about 13.0 inches while the angular displacement 124 between the top surface 71 of the pedal lever 56 and the horizontal reference plane 126 has decreased to about 7.1°.

Figure 6E:
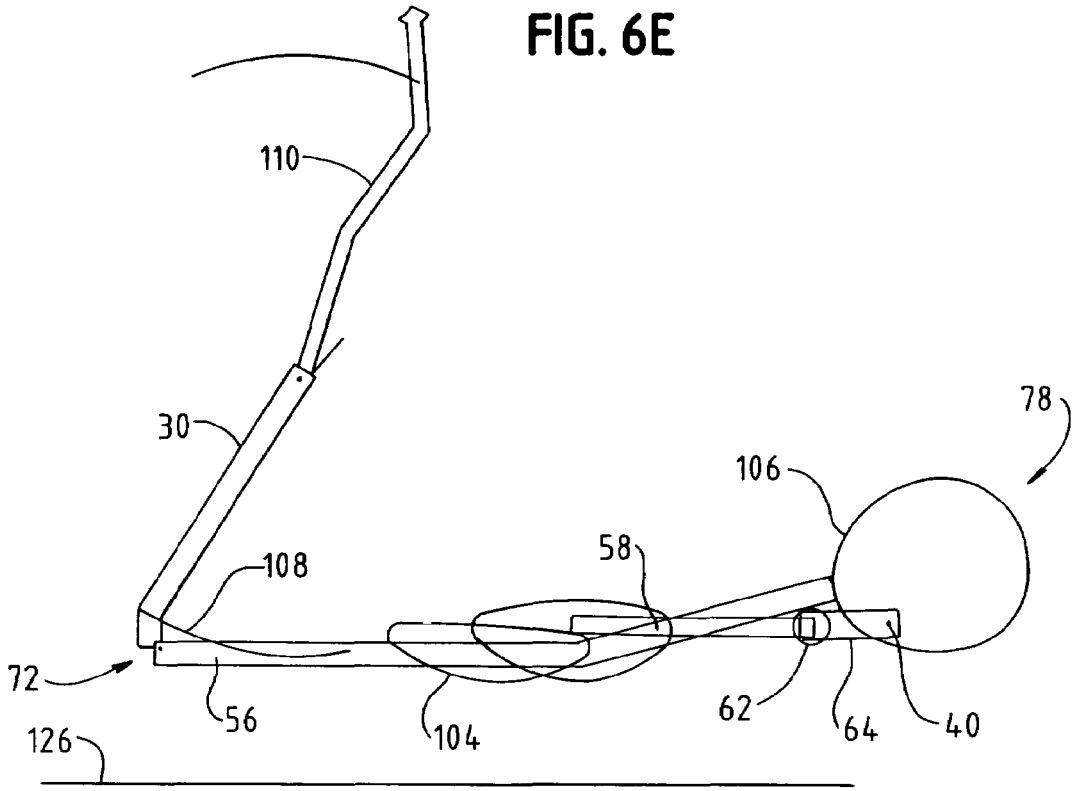

Continued rotation of the pulley 38 on the pivot axle 40 by about another 45° brings the pedal 32 to the position shown in FIG. 6E, where the forward end 72 of the first portion 66 of the pedal lever 56 has traveled the entire distance along the reciprocating arcuate pathway 108. The varying angular displacement 128 has now changed to about 0.4°, while the angle 130 remains 0°. The linear displacement 132 between the top surface 103 of the pedal 32 and the horizontal reference plane 126 has decreased to about 12.2 inches and the angular displacement 128 between the top surface 71 of the pedal lever 56 and the horizontal reference plane 126 has decreased to about 0.4°.

Figure 6F:
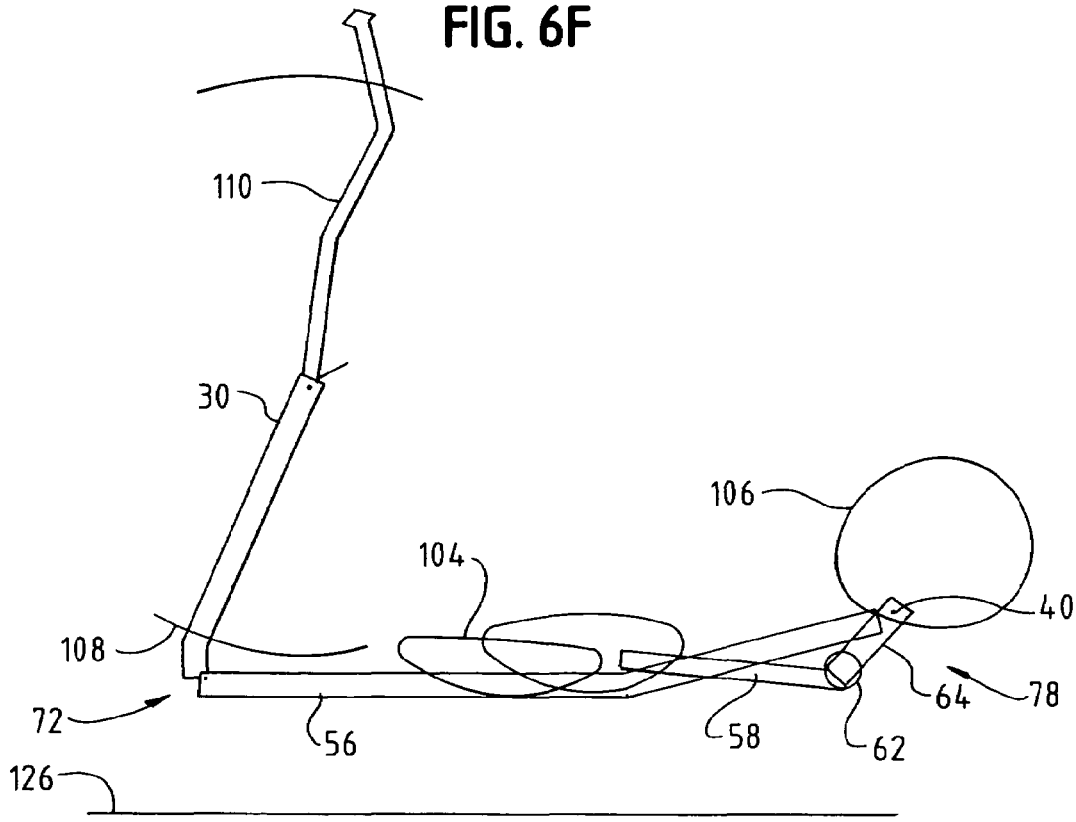

Forward rotation of the pulley 38 on the pivot axle 40 by about another 45° moves the forward end 72 of the first portion 66 of the pedal lever 56 backwards by about one-fourth of the distance along the reciprocating arcuate pathway 108, toward the pivot axle 40, and brings the pedal 32 to the position shown in FIG. 6F. Although the angle 130 between the top surface 103 of the pedal 32 and top surface 71 of the pedal lever 56 remains 0°, the angular displacement 128 between the top surface 103 of the pedal 32 and the horizontal reference plane 126 has decreased to about −2.7°. The linear displacement 132 between the point 134 and the horizontal reference plane 126 has decreased to about 9.3 inches and the angular displacement 124 between the top surface 71 of the pedal lever 56 and the horizontal reference plane 126 has decreased to about −2.7°. The pedal 32 is now in the lower portion of the elliptical pathway 104 which corresponds to the second half of the forward-stepping motion.

Figure 6G:
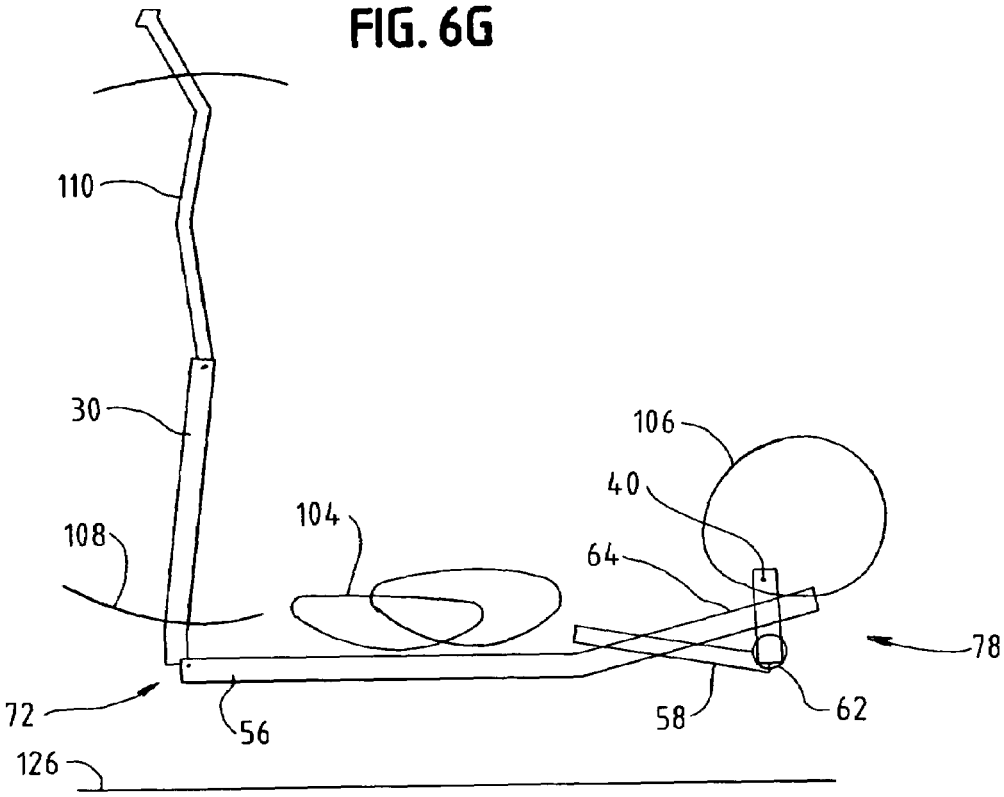

Continued rotation of the pulley 38 on the pivot axle 40 by about another 45° brings the pedal 32 to the position shown in FIG. 6G, at which point the forward end 72 of the first portion 66 of the pedal lever 56 has traveled backwards about half-way along the reciprocating arcuate pathway 108 towards the pivot axle 40. The angular displacement 128 between the top surface 103 of the pedal 32 and the horizontal reference plane 126 has increased to about −2.3° although the angle 130 remains 0°. The linear displacement 132 between the point 134 and the horizontal reference plane 126 has decreased even further, to about 7.3 inches, and the angular displacement 124 between the top surface 71 of the pedal lever 56 and the horizontal reference plane 126 has increased to about −2.3°.

Figure 6H:
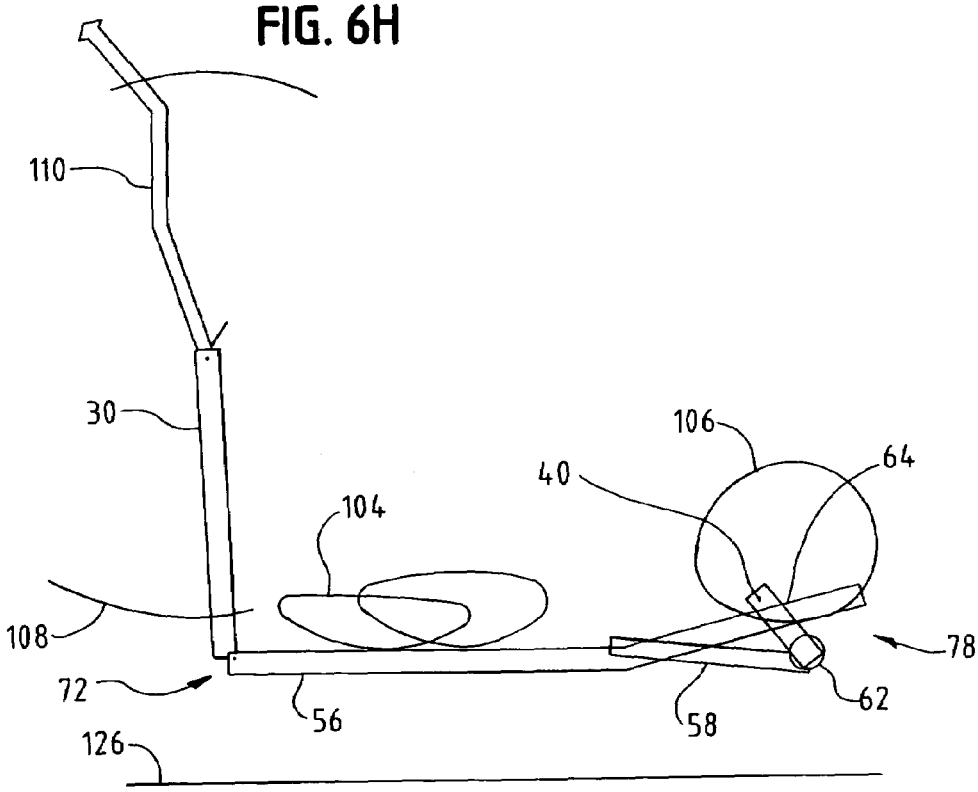

Forward rotation of the pulley 38 on the pivot axle 40 by about another 45° moves the forward end 72 of the first portion 66 of the pedal lever 56 backwards to a position that is about three-fourths of the distance along the reciprocating arcuate pathway 108, towards the pivot axle 40, and brings the pedal 32 to the position shown in FIG. 6H. Even though the angle 130 between the top surface 103 of the pedal 32 and the top surface 71 of the pedal lever 56 remains 0°, the angular displacement 128 between the top surface 103 of the pedal 32 and the horizontal reference plane 126 has increased to about 0.5°. In addition, the linear displacement 132 between the point 134 on the top surface 103 of the pedal 32 and the horizontal reference plane 126 has increased to about 7.8 inches and the angular displacement 124 between the top surface 71 of the pedal lever 56 and the horizontal reference plane 126 has increased to about 0.5°. Continued rotation of the pulley 38 on the pivot axle 40 by about another 45° completes the forward-stepping motion along the elliptical pathway 104 and brings the forward end 72 of the first portion 66 of the pedal lever 56 back to the rearmost position along the reciprocating arcuate pathway 108 and the pedal 32 back to the position shown in FIG. 6A.

The foregoing examples of displacements and angles represent a preferred motion of the pedal 32. It should be understood, however, that these motions can be changed by varying various parameters of the pedal actuation assembly 34 such as the lengths of the crank 64 and the length of the extension arm 60 as well as changing the relative height of the pivot axle 40.

As a result of the bent pedal lever 56, the exercise apparatus 10 is easy for the user to mount. When the user then operates the pedal 32 in the previously described manner, the pedal 32 moves along the elliptical pathway 104 in a manner that stimulates a natural heel to toe flexure that minimizes or eliminates stresses due to the unnatural foot flexures. If the user employees the moving upper handle 110, the exercise apparatus 10 exercises the user's upper body concurrently with the user's lower body thereby providing a total cross-training workout. The exercise apparatus 10 thus provides a wide variety of exercise programs that can be tailored to the specific needs and desires of individual users, and consequently, enhances exercise efficiency and promotes a pleasurable exercise experience.

III. Detailed Description of the Second General Embodiment

Figure 7:
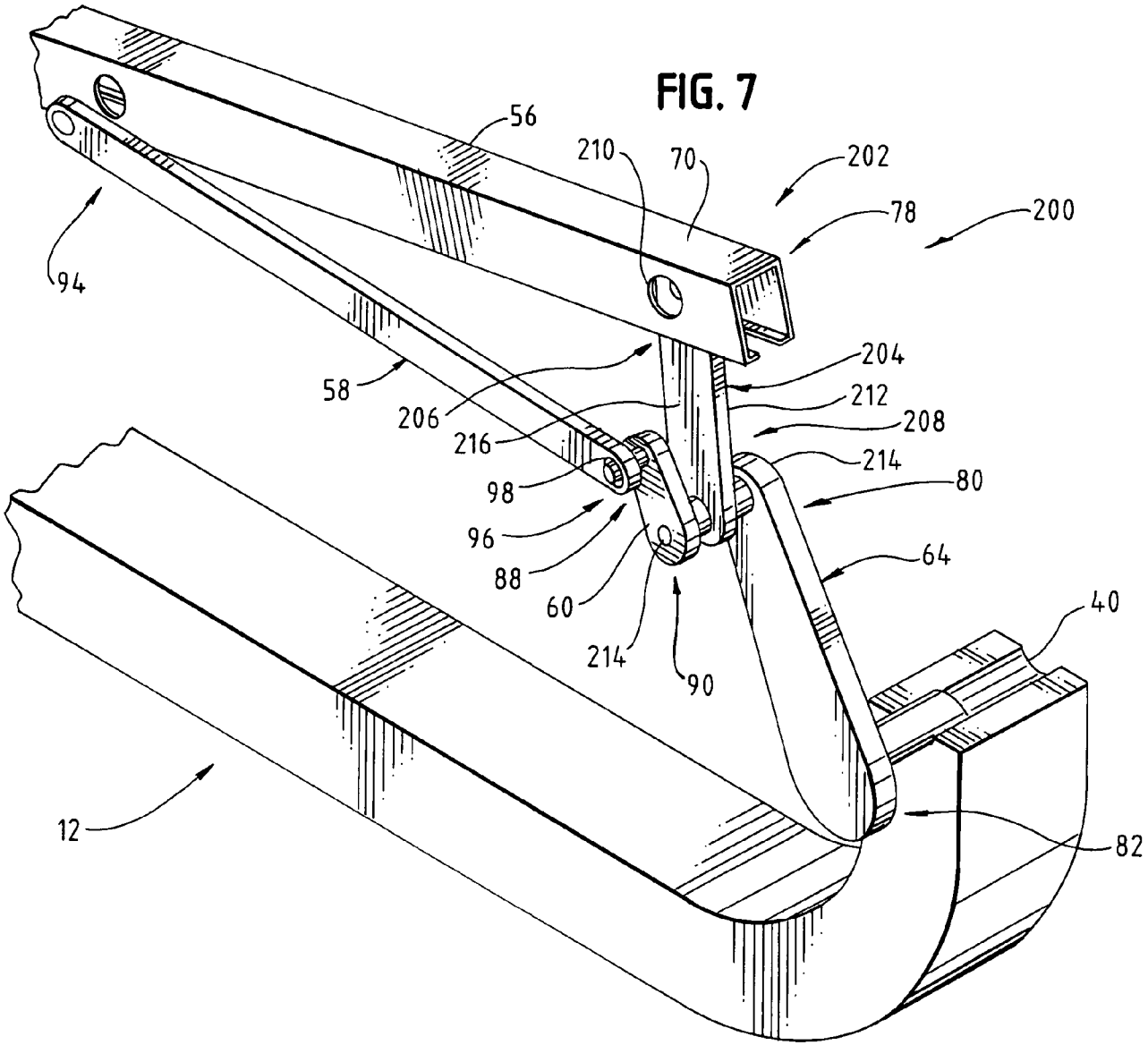
FIG. 7 is a partial simplified side perspective view of a second embodiment of an exercise apparatus according to the invention.

FIG. 7 shows a second general embodiment of an exercise apparatus 200 according to the invention. As noted previously, the second embodiment of the exercise apparatus 200 of the invention includes a second type of pedal actuation assembly and therefore implements the desired elliptical pedal motion in a similar fashion as the exercise apparatus 10. As with the exercise apparatus 10, the exercise apparatus 200 includes, but is not limited to, the frame 12, the pedal 32, the pulley 38 and associated pivot axle 40, the pedal lever 56, the upper handle 110, and the various motion controlling components, such as the alternator 42 and the transmission 44. The exercise apparatus 200 differs primarily from the exercise apparatus 10, along with the various embodiments that follow, in the nature and construction of the pedal actuation assembly. As noted earlier, the pedal actuation assembly refers to those components which cooperate to (1) provide an elliptical path and (2) provide the desired foot flexure and weight distribution on the pedal 32.

The pedal actuation assembly 202 of the exercise apparatus 200 includes the stroke link 58, the extension arm 60, the crank 64 and a rise link 204. Similar to the pedal actuation assembly 34, in the pedal actuation assembly 202, the rearward end 82 of the crank 64 is pivotally attached to and rotates about the pivot axle 40. Additionally, the forward end 94 of the stroke link 58 is pivotally attached to the pedal lever 56 by any suitable securing means. The rearward end 96 of the stroke link 58 is pivotally attached to and rotates about the forward end 88 of the extension arm 60 at the pivot point 98.

The rise link 204 of the pedal actuation assembly 202 includes an upper portion 206 and a lower portion 208. The upper portion 206 of the rise link 204 is pivotally connected to the rearward end 78 of the third portion 70 of the pedal lever 56 at a pivot point 210. The forward end 80 of the crank 64 is pivotally connected to and rotates about the lower portion 208 of the rise link 204 on an inner portion 212 of the rise link 204 at a pivot point or shaft 214. The rearward end 90 of the extension arm 60 similarly pivots about and is connected to the lower portion 208 of the rise link 204 on an outer portion 216 of the rise link 204 at the pivot point or shaft 214. Thus, the significant difference between the pedal actuation assembly 202 of the exercise apparatus 200 and the pedal actuation assembly 34 of the exercise apparatus 10 is that the pedal lever 56 of the exercise apparatus 10 rests on the roller 62 while the pedal lever 56 of the exercise apparatus 200 is pivotally attached to the rise link 204.

During operation, the rise link 204 of the pedal actuation assembly 202 of the exercise apparatus 200 controls the vertical movement of the third portion 70 of the pedal lever 56. Similarly to the exercise apparatus 10, in the exercise apparatus 200, the stroke link 58 primarily controls the horizontal movement of the pedal lever 56. The geometry of the pedal actuation assembly 202 of the exercise apparatus 200 is such that the horizontal movement of the pedal lever 56 is greater than the vertical movement.

When the user operates the exercise apparatus 200 as described, the pedal 32 moves along the elliptical pathway 104 in a manner that simulates a natural heel to toe flexure that minimizes or eliminates stresses due to unnatural foot flexure. The exercise apparatus 200 thus also provides a wide variety of exercise programs that can be tailored to the specific needs and desires of individual users, and consequently, enhances exercise efficiency and promotes a pleasurable exercise experience.

IV. Detailed Description of the Third Embodiment

Figure 8:
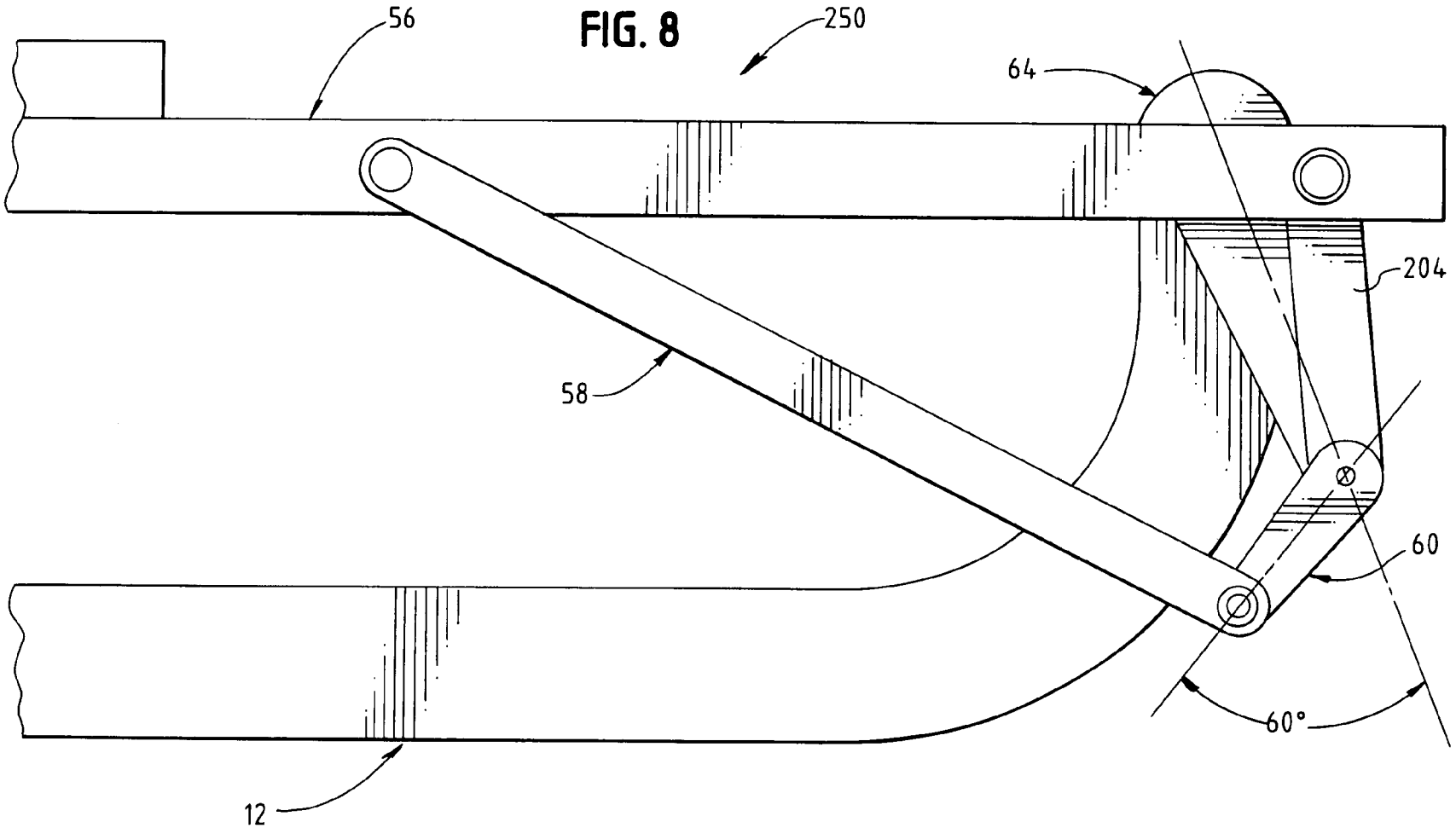
FIG. 8 is a partial simplified side view of a third embodiment of an exercise apparatus according to the invention.
Figure 9:
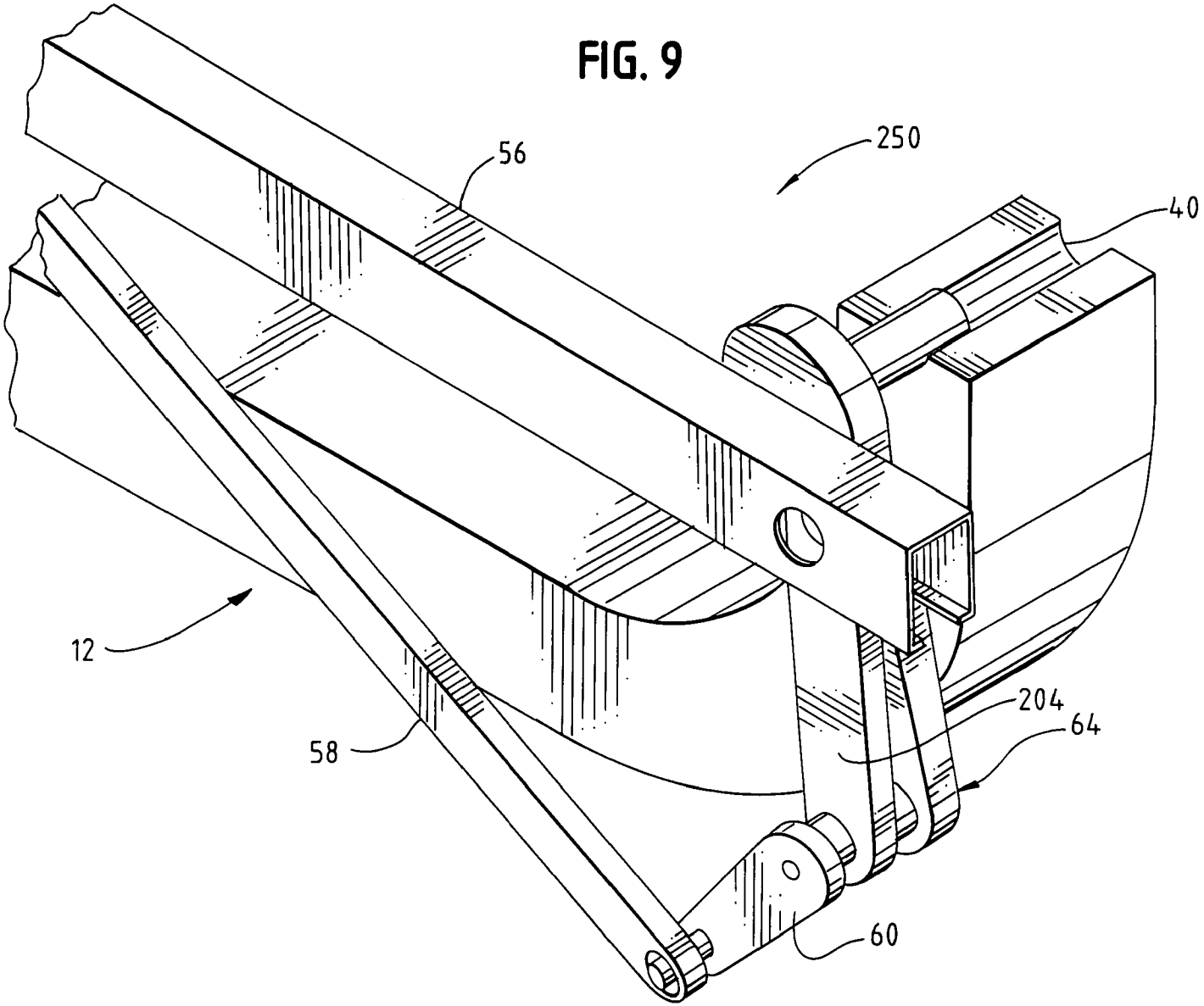
FIG. 9 is a partial simplified side perspective view of the exercise apparatus in FIG. 8.

FIGS. 8–9 show a third general embodiment of an exercise apparatus 250 according to the invention. As noted previously, the third embodiment of the exercise apparatus 250 of the invention includes a third type of pedal actuation assembly and therefore implements the desired elliptical pedal motion in a similar fashion as the exercise apparatuses 10 and 200. As with the previous embodiments of the exercise apparatuses 10 and 200, the exercise apparatus 250 includes, but is not limited to, the frame 12, the pedal 32, the pulley 38 and associated pivot axle 40, the pedal lever 56, and the various motion controlling components, such as the alternator 42 and the transmission 44. The exercise apparatus 250 differs primarily from the exercise apparatus 10 and 200 along with the various embodiments that follow, in the nature and construction of the pedal actuation assembly.

Specifically, a pedal actuation assembly 252 of the exercise apparatus 250 is identical to the pedal actuation assembly 202 of the exercise apparatus 200 except that the crank 64 has been displaced at an angle relative to the extension arm 60 to modify the motion of the pedal lever 56. As shown in FIGS. 8 and 9, the extension arm 60 is displaced approximately 60° C. relative to the crank 64. Thus, as the crank 64 rotates counterclockwise, the crank 64 will be time phased ahead of the extension arm 60. Changing the fixed angle between the crank 64 and the extension arm 60 offers a method for tuning the motion of the pedal 32.

Thus, when the user operates the exercise apparatus 250 as described above, the pedal 32 moves along the elliptical pathway 104 in a manner that simulates a natural heel to toe flexure that minimizes or eliminates stresses due to unnatural foot flexures. The exercise apparatus 250 thus also provides a wide variety of exercise programs that can be tailored to the specific needs and desires of individual users, and consequently, enhances exercise efficiency and promotes a pleasurable exercise experience.

IV. Detailed Description of the Fourth General Embodiment

Figure 10:
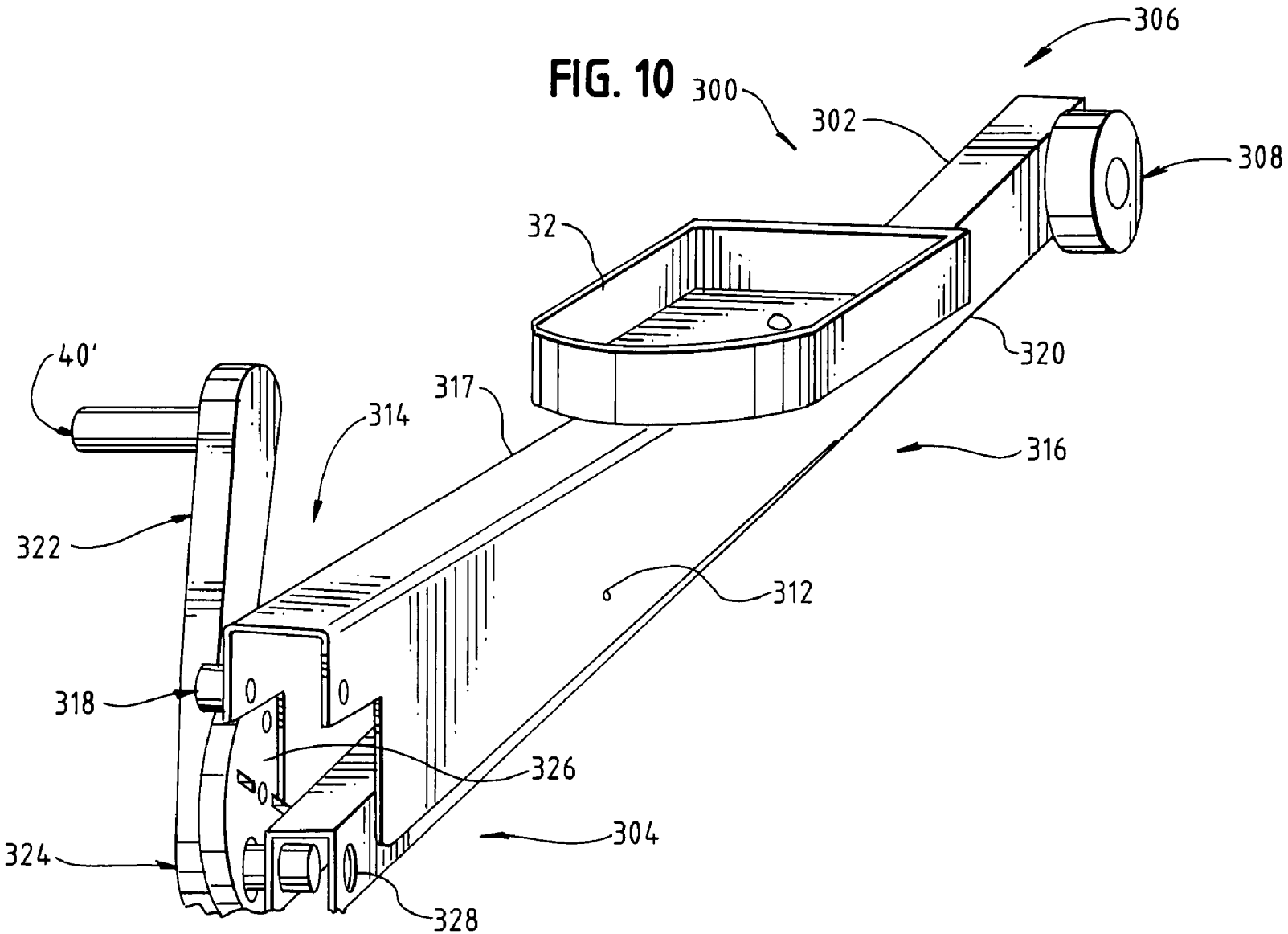
FIG. 10 is a partial simplified perspective view of a fourth embodiment of an exercise apparatus according to the invention.

FIG. 10 shows a fourth embodiment of an exercise apparatus 300 according to the invention. As noted previously, the fourth embodiment of the exercise apparatus 300 of the invention include a fourth type of pedal actuation assembly and therefore implements the desired elliptical pedal motion in a similar fashion as the exercise apparatuses 10, 200 and 250. As with the previous exercise apparatuses 10, 200 and 250, the exercise apparatus 300 includes, but is not limited to, the frame 12, the pedal 32, the pulley 38 and associated pivot axle 40' (which corresponds generally in function to the pivot axle 40 described in the previous embodiments), and the various motion controlling components, such as the alternator 42 and the transmission 44.

As shown in FIG. 10, the exercise apparatus 300 differs primarily from the previous exercise apparatuses 10, 200 and 250, along with the various embodiments that follow, in that the crank is positioned in front of the user. The exercise apparatus 300 includes a pedal lever 302 having a forward end 304 and a rearward end 306. Attached to the rearward end 306 of the pedal lever 302 is a roller 308 which rides in a track 310. The track 310 is attached to the frame 12. The exercise apparatus 300 further includes a pedal mount link 312 having a forward end 314, a rearward end 316 and an upper surface 317. A cam follower 318 is rotatably attached to the forward end 314 of the pedal mount link 312. The rearward end 316 of the pedal mount link 312 is pivotally connected to the pedal lever 302 at a pivot point 320. The pedal 32 is rigidly attached to the upper surface 317 of the pedal mount link 312. The exercise apparatus 300 further includes a crank 322 having a lower end 324. Bolted to the crank 322 is a cam 326. The lower end 324 of the crank 322 and the cam 326 are pivotally attached to the forward end 304 of the pedal lever 302 at a pivot point 328. Moreover, the cam 326 contacts the cam follower 318 on the pedal mount link 312.

As the crank 322 rotates, the pedal lever 302 is caused to reciprocate. Moreover, as the crank 322 rotates, the cam 326 and the cam follower 318 cause the pedal mount link 312 and the pedal lever 302 to articulate relative to one another. The exercise apparatus 300 offers the advantage of having a crank connected directly to the pedal lever. This direct connection better stabilizes the pedal lever, which allows using one roller instead of two. The purpose for introducing the pedal mount link 312 and the cam 326 is to provide a means for tuning the motion of the pedal 32. Similarly, when the user operates the pedal 32 in the above-described manner, the pedal 32 moves along the elliptical pathway 104 in a manner that simulates a natural heel to toe flexure that minimizes or eliminates stresses due to unnatural foot flexures. The exercise apparatus 300 thus provides a wide variety of exercise programs that can be tailored to the specific needs and desires of individual users, and consequently, enhances exercise efficiency and promotes a pleasurable exercise experience.

V. Detailed Description of the Fifth General Embodiment

Figure 11:
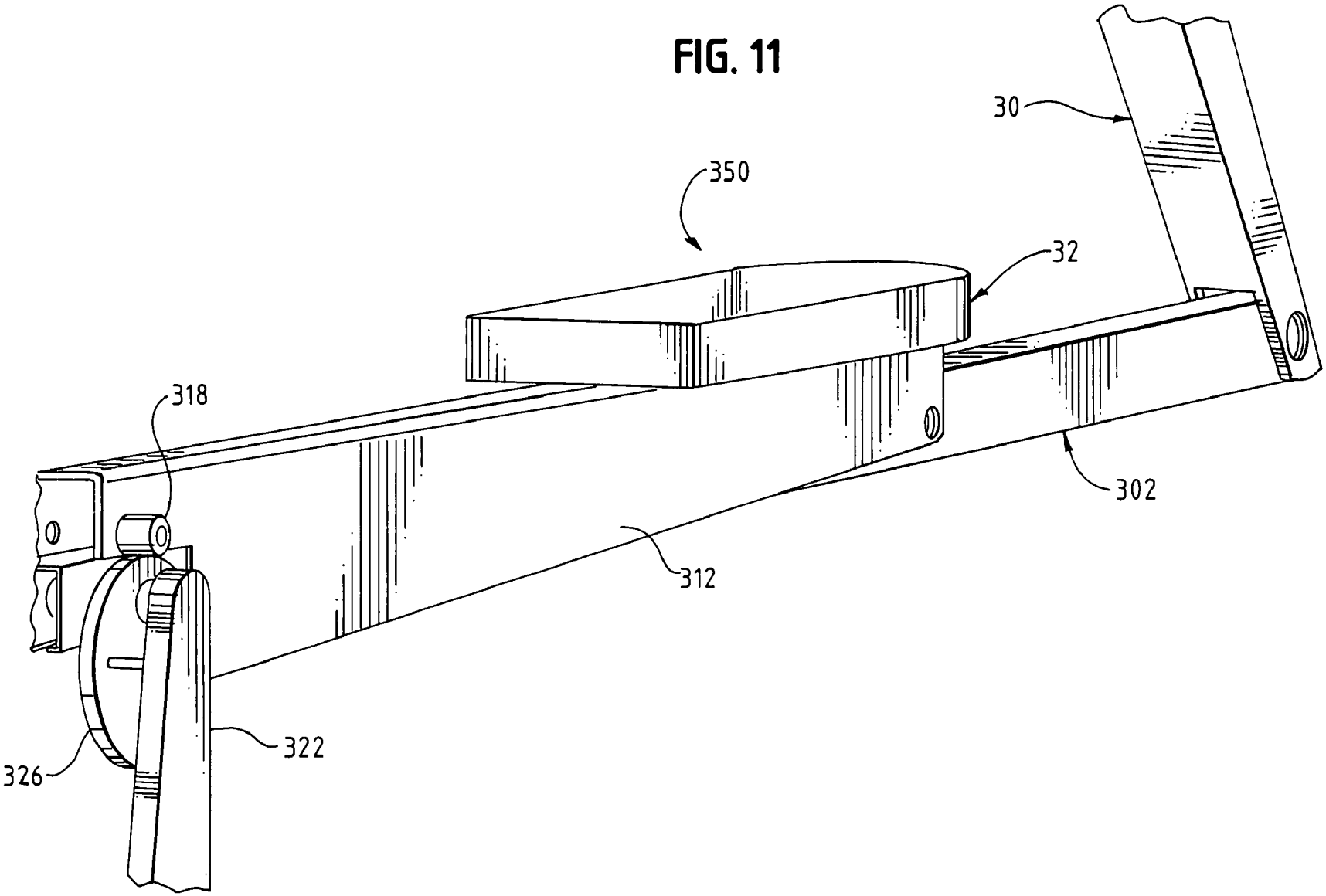
FIG. 11 is a partial simplified side perspective view of a fifth embodiment of an exercise apparatus according to the invention.
Figure 12:
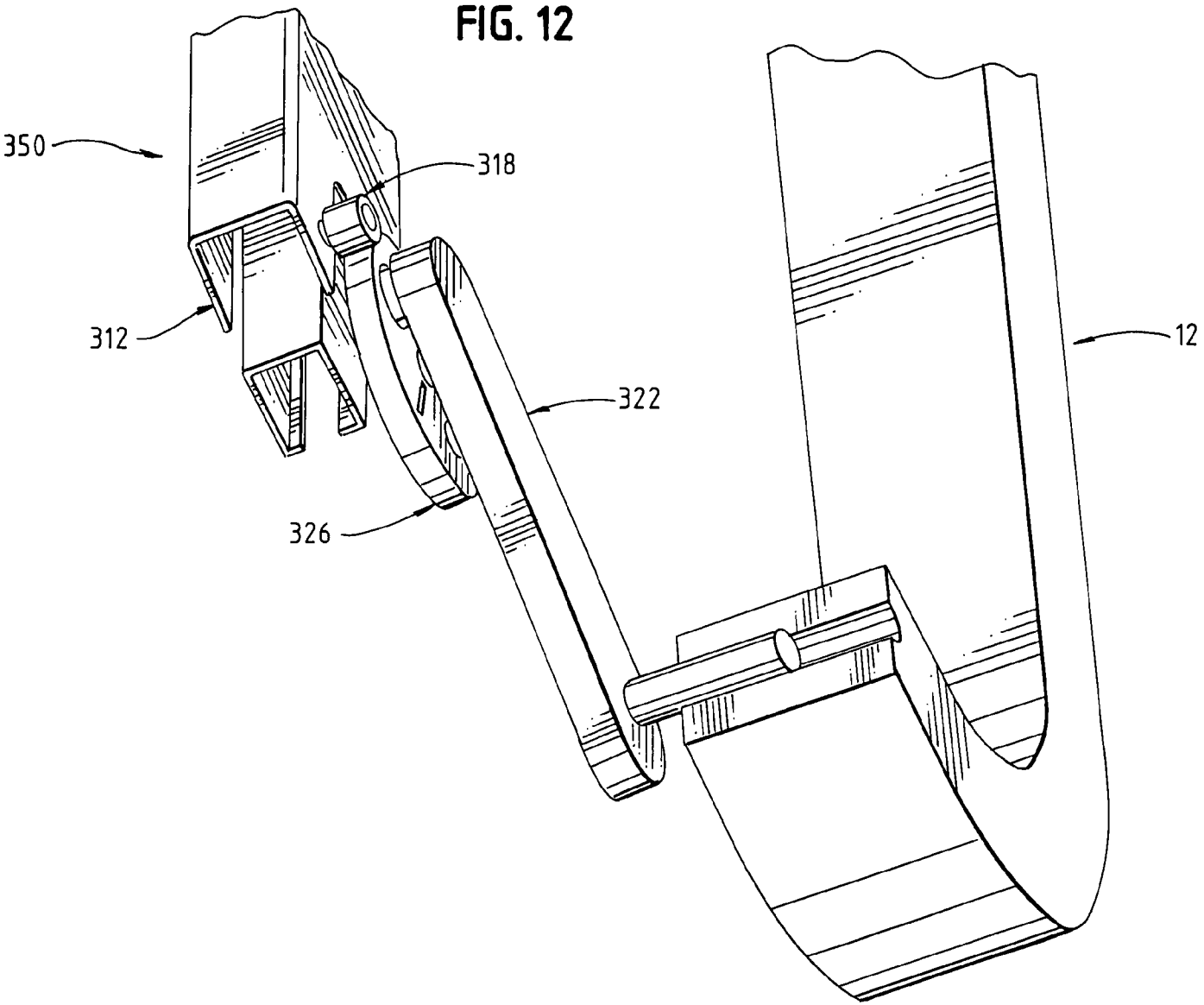
FIG. 12 is a partial simplified rear perspective view of the exercise apparatus in FIG. 11.

FIGS. 11 and 12 show a fifth general embodiment of an exercise apparatus 350 according to the invention. As noted previously, the fifth embodiment of the exercise apparatus 350 of the invention includes a fifth type of pedal actuation assembly and therefore implements the desired elliptical pedal motion in a similar fashion as the exercise apparatuses 10, 200, 250 and 300. As with the previous exercise apparatuses 10, 200, 250 and 300, the exercise apparatus 350 includes, but is not limited to, the frame 12, the pedal 32, the pulley 38 and associated pivot axle 40, and the various motion controlling components, such as the alternator 42 and the transmission 44. The exercise apparatus 350 is also similar to the exercise apparatus 300 including, but not limited to, the pedal lever 302, the pedal mount link 312, the cam follower 318, the crank 322 and the cam 326. The major difference between the exercise apparatus 300 and the exercise apparatus 350 are that the above described components are behind the user in the exercise apparatus 350 instead of in front of the user in the exercise apparatus 300.

As illustrated, the exercise apparatus 350 also replaces the roller 308 and the track 310 of the exercise apparatus 300 with the rocker 30. As previously discussed, the rocker 30 is pivotally attached to the frame 12.

In the exercise apparatus 350, the cam 326 aids in fine tuning the motion of the pedal 32, particularly the heel to toe flexure relationship. When the user operates the pedal 32 in the previously described manner, the pedal 32 moves along the elliptical pathway 104 in a manner that simulates a natural heel to toe flexure that minimizes or eliminates stresses due to the unnatural foot flexures. Thus, the exercise apparatus 350 similarly provides a wide variety of exercise programs that can be tailored to the specific needs and desires of individual users, and consequently, enhances exercise efficiency and promotes a pleasurable exercise experience.

VI. Detailed Description of the Sixth General Embodiment

Figure 13:
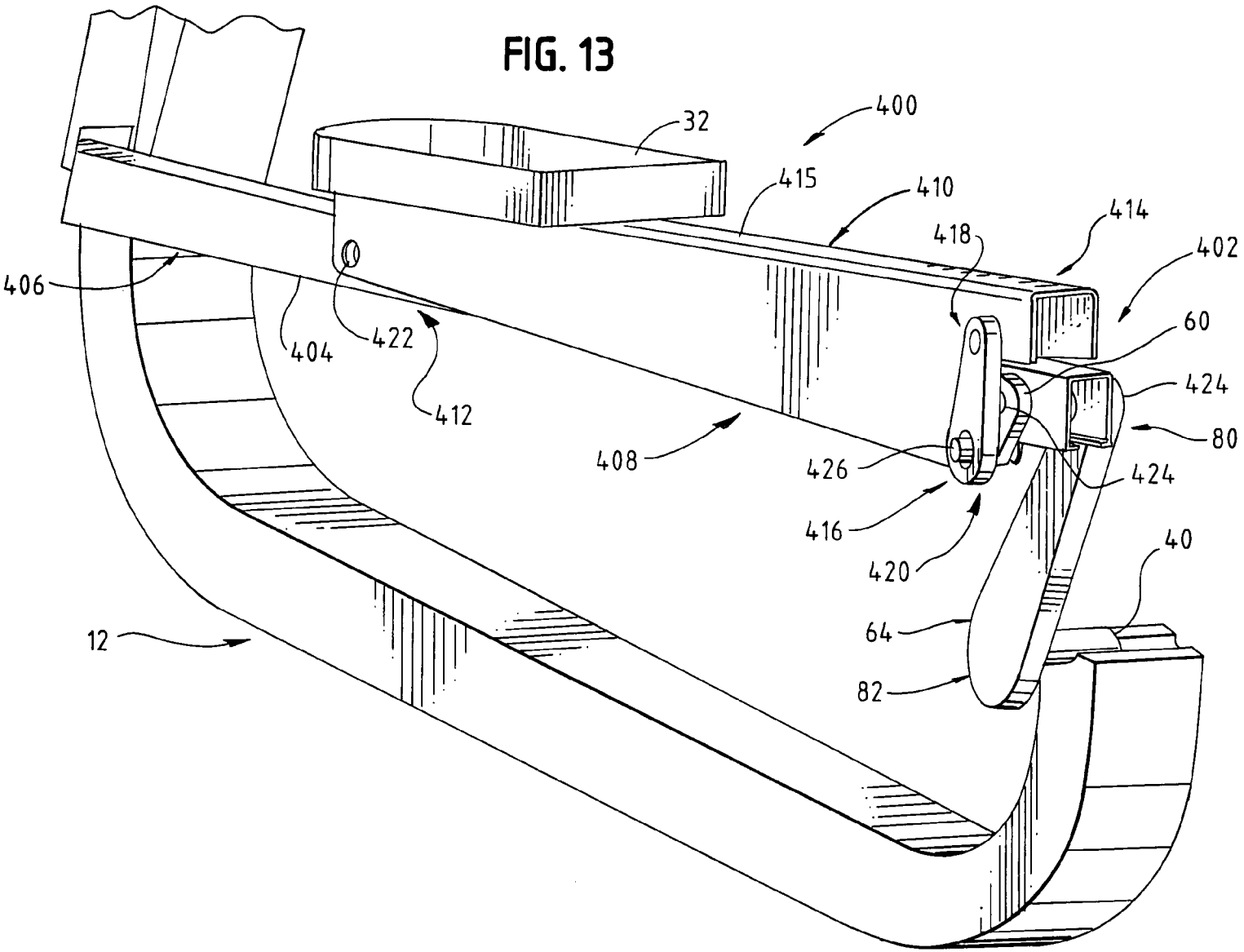
FIG. 13 is a partial simplified side perspective view of a sixth embodiment of an exercise apparatus according to the invention.

FIG. 13 shows a sixth general embodiment of an exercise apparatus 400 according to the invention. As noted previously, the exercise apparatus 400 of the invention includes a sixth type of pedal actuation assembly and therefore implements the desired the elliptical pedal motion in a similar fashion as the exercise apparatuses 10, 200, 250, 300 and 350. As with the previous exercise apparatuses 10, 200, 250, 300 and 350, the exercise apparatus 400 includes, but is not limited to, the frame 12, the pedal 32, the pulley 38 and associated pivot axle 40, and the various motion controlling components, such as the alternator 42 and the transmission 44. The exercise apparatus 400 differs primarily from the previous exercise apparatuses 10, 200, 250, 300 and 350, along with the embodiment that follows, in the nature and construction of the pedal actuation assembly. As noted earlier, the pedal actuation assembly refers to those components which cooperate to (1) provide an elliptical path and (2) provide the desired foot flexure and weight distribution of the pedal 32.

A pedal actuation assembly 402 of the exercise apparatus 400 includes a pedal lever 404 having a forward end 406 and a rearward end 408, a pedal mount link 410 having a forward end 412, a rearward end 414 and a top surface 415, and a pickle link 416 having an upper portion 418 and a lower portion 420. The pedal actuation assembly 402 of the exercise apparatus 400 further includes the rocker 30, the pedal 32, the extension arm 60, and the crank 64. The forward end 406 of the pedal lever 404 is pivotally connected to the rocker 30. As previously set forth above, the rocker 30 is then pivotally attached to the frame 12. The pedal 32 is rigidly attached to the top surface 415 of the pedal mount link 410. The forward end 412 of the pedal mount link 410 is pivotally attached to the pedal lever 404 at a pivot point 422.

As explained in more detail above, the rearward end 82 of the crank 64 is pivotally connected to the pivot axle 40. The forward end 80 of the crank 64 is pivotally connected to the rearward end 408 of the pedal lever 404 at a pivot point 424. The rearward end 90 of the extension arm 60 is similarly pivotally connected to the rearward end 408 of the pedal lever 404 at the pivot point 424. The forward end 88 of the extension arm 60 is pivotally connected to the lower portion 420 of the pickle link 416 at a pivot point 426. The upper portion 418 of the pickle link 416 is pivotally connected to the rearward end 414 of the pedal mount link 410 by any suitable connecting means.

The exercise apparatus 400 produces a similar motion as the exercise apparatuses 300 and 350 having the cam 326. As the crank 64 rotates, the pickle link 416 and the extension arm 60 cause the pedal mount link 410 and the pedal lever 404 to articulate relative to one another. The longer the extension arm 60, the more the pedal mount link 410 will articulate relative to the pedal lever 404. Thus, the pedal actuation assembly 402 of the exercise apparatus 400 provides a means for tuning the motion of the pedal 32.

In this regard, when the user operates the pedal 32 in the previously described manner, the pedal 32 moves along the elliptical pathway 104 in a manner that stimulates a natural heel to toe flexure that minimizes or eliminates stresses due to unnatural foot flexure. Similarly, the exercise apparatus 400 thus provides a wide variety of exercise programs that can be tailored to the specific needs and desires of individual users, and consequently, enhances exercise efficiency and promotes a pleasurable exercise experience.

VII. Detailed Description of the Seventh General Embodiment

Figure 14:
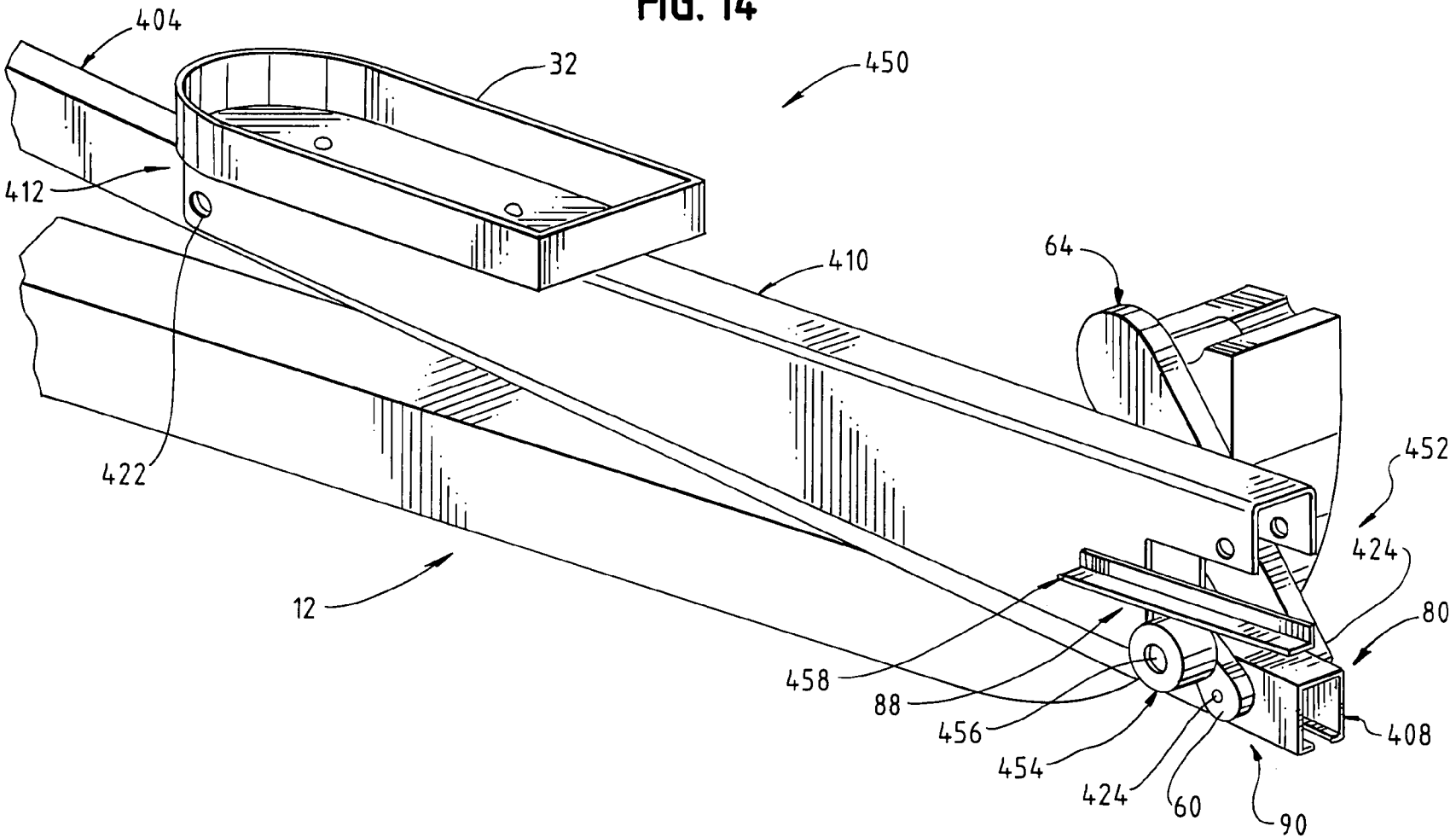
FIG. 14 is a partial simplified side perspective view of a seventh embodiment of an exercise apparatus according to the invention.

FIG. 14 shows a seventh general embodiment of an exercise apparatus 450 according to the invention. As noted previously, the exercise apparatus 450 of the invention includes a seventh type of pedal actuation assembly and therefore implements the desired elliptical pedal motion in a similar fashion as the exercise apparatuses 10, 200, 250, 300, 350 and 400. As with the previous exercise apparatuses 10, 200, 250, 300, 350 and 400, the exercise apparatus 450 includes, but is not limited to, the frame 12, the rocker 30, the pedal 32, the pulley 38 and associated pivot axle 40, and the various motion controlling components, such as the alternator 42 and the transmission 44. The exercise apparatus 450 differs primarily from the exercise apparatus 400, along with the various embodiments described above, in the nature and construction of the pedal actuation assembly. As noted earlier, the pedal actuation assembly refers to those components which cooperate to (1) provide an elliptical path and (2) provide the desired foot flexure and weight distribution on the pedal 32.

A pedal actuation assembly 452 of the exercise apparatus 450 includes the pedal lever 404, the pedal mount link 410, the pedal 32, the crank 64 and the extension arm 60. The exercise apparatus 450 differs from the exercise apparatus 400 in that the pickle link 416 attached to the rearward end 414 of the pedal mount link 410 is replaced by a roller 454. As explained in more detail above, the forward end 412 of the pedal mount link 410 of the exercise apparatus 450 is pivotally connected to the pedal lever 404 at the pivot point 422. The forward end 80 of the crank 64 is pivotally connected to the rearward end 408 of the pedal lever 404 at the pivot point 424 while the rearward end 90 of the extension arm 60 is pivotally connected to the rearward end 408 of the pedal lever 404 at the pivot point 424. The roller 454 is pivotally connected to and rotates about the forward end 88 of the extension arm 60 on a shaft 456. Additionally, a track 458 is attached to the rearward end 414 of the pedal mount link 410 by any suitable attachment means. The roller 454 contacts and rolls along the track 458.

As the crank 64 rotates, the roller 454 and the extension arm 60 cause the pedal mount link 410 and the pedal lever 404 to articulate relative to one another. This provides a means for tuning the motion of the pedal 32. Thus, when the user operates the pedal 32 in the previously described manner, the pedal 32 moves along the elliptical pathway 104 in a manner that simulates a natural heel to toe flexure that minimizes or eliminates stresses due to unnatural foot flexures. Similarly, the exercise apparatus 450 thus provides a wide variety of exercise programs that can be tailored to the specific needs and desires of individual users, and consequently, enhances exercise efficiency and promotes a pleasurable exercise experience.

VIII. Overview of the Control System of the Invention

Figure 15:
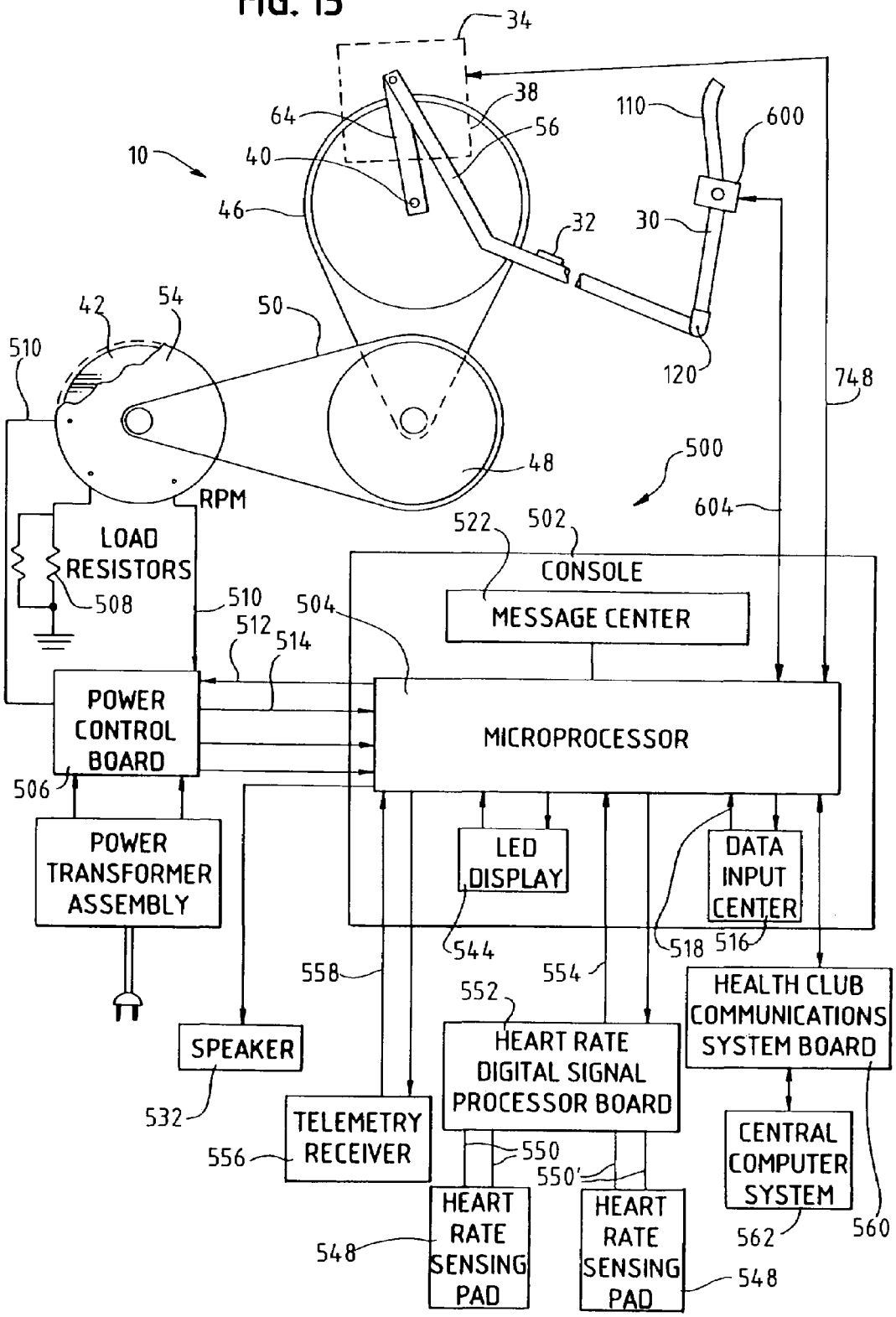
FIG. 15 is a schematic block diagram of the various mechanical and electrical functions of the type of exercise apparatus shown in FIG. 1.
Figure 16:
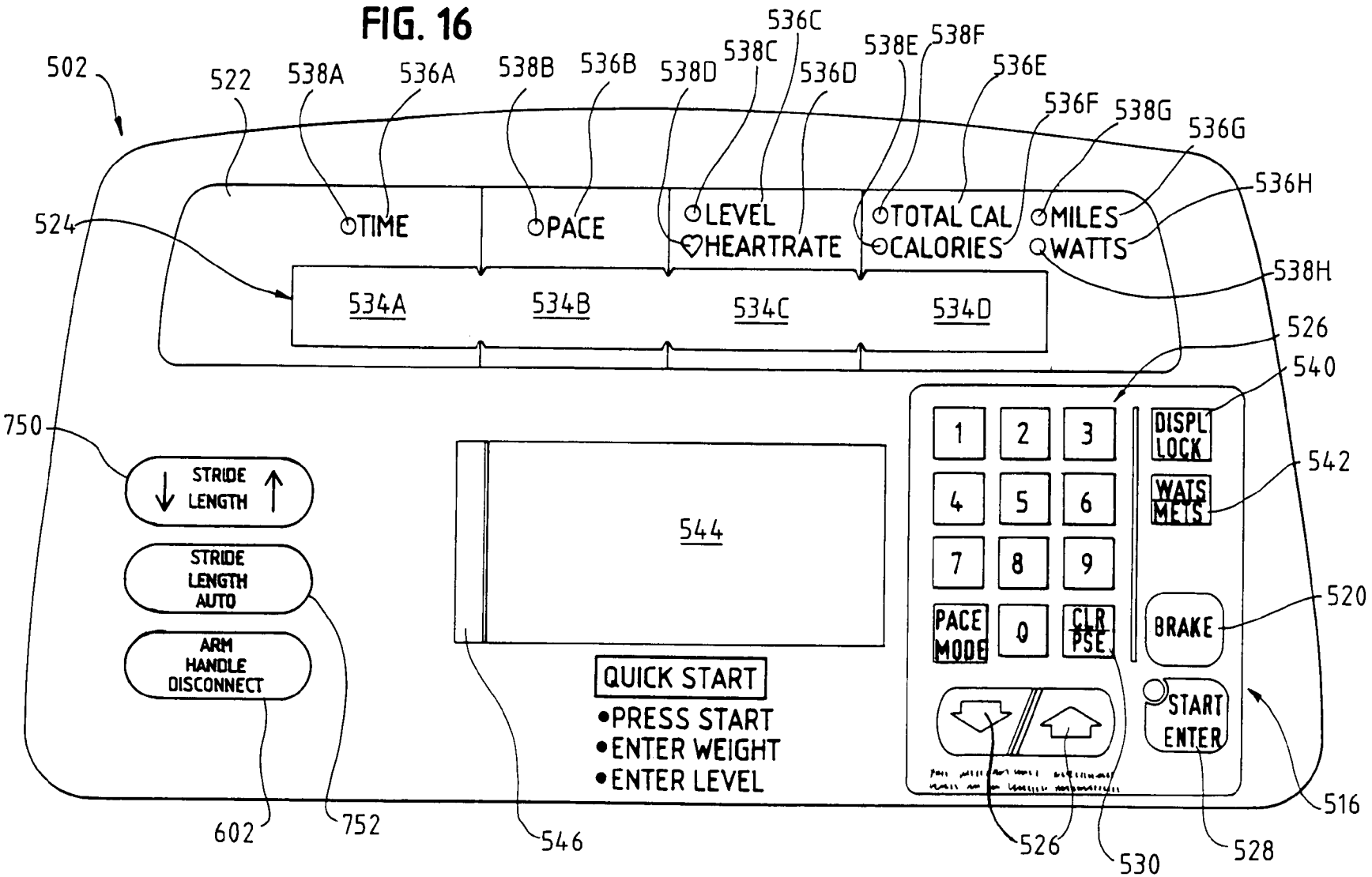
FIG. 16 is a plan layout of the display console of the type of exercise apparatus shown in FIG. 1.

FIGS. 15 and 16 provide illustrations of a control system 500 and a user input and display console 502 that can be used with elliptical exercise apparatus of the type disclosed herein.

To provide a representative environment for describing the invention, FIG. 15 shows in schematic form a number of the basic mechanical components of an elliptical step exercise apparatus of the type generally indicated by 10 shown in FIGS. 1–4 where elements that generally correspond in function are shown with reference numerals that correspond to the reference numerals in FIGS. 1–4. It should be understood that the components shown in FIG. 15 can generally correspond in function to other elliptical step apparatus having different mechanical arrangements such as the apparatus shown in U.S. Pat. Nos. 6,099,439 or 5,895,339. Here, the resistive force generating components of the exercise apparatus 10 include the alternator 42 which, together with the transmission 44, transmits the resistive force to the pedal 32 and to the arm 110. As indicated above, other sources of resistive force can be used such as an eddy current brake, a friction brake, a band brake or a hydraulic braking system. In some cases it might be desirable to use a transmission such as the transmission 44 which in this example includes the pulley 38 which is coupled by the belt 46 to a second pulley 48. The second belt 50 is connected to the flywheel 54 of the alternator 42. The transmission 44 thereby transmits the resistive force provided by the alternator 42 to the pedal 32 and the arm handle 110. In the preferred embodiment of the control system 500, a microprocessor 504 is housed within the console 502 and is operatively connected to the alternator 42 via a power control board 506. The alternator 42 is also operatively corrected to a ground through a resistance load source 508. A pulse width modulated output signal on a line 510 from the power control board 506 is controlled by the microprocessor 504 and varies the current applied to the field of the alternator 42 by a predetermined field control signal on a line 512, in order to provide a resistive force which is transmitted to the pedal 32 and to the arm 110. In the preferred embodiment, the output signal 510 is continuously transmitted to the alternator 42, even when the pedal 32 is at rest. Consequently, when the user first steps on the pedal 32 to begin exercising, the braking force provided by the alternator 42 prevents the pedal 32 and the arm 110 from moving unexpectedly. Specifically, when the pedal 32 is at rest, the output signal 510 is set at a predetermined value which provides the minimum current that is needed to measure the RPM of the flywheel 54. In the presently preferred embodiment, the minimum field current provided by the output signal 510 is 3%–6% of the maximum field current. When the user first steps on the pedal 32, the initial motion of the pedal 32 is detected as a change in the RPM signal which represents pedal speed on a line 514, whereupon the microprocessor 504 maximizes the field control signal 510 thereby braking the pedal 32 and the arm 110. It should be noted that other types of speed sensors such as optical sensors can be used in machines of the type 10 to provide pedal speed signals. Thereafter, as explained in more detail below, the resistive force of the alternator 42 is varied by the microprocessor 504 in accordance with the specific exercise program selected by the user so that the user can operate the pedal 32 as previously described.

The alternator 42 and the microprocessor 504 also interact to stop the motion of the pedal 32 when, for example, the user wants to terminate his exercise session on the apparatus 10. A data input center 516, which is operatively connected to the microprocessor 86 over al line 518, includes a brake key 520, as shown in FIG. 16, that can be employed by the user to stop the rotation of the pulley 38 and hence the motion of the pedal 32. When the user depresses the brake key 520, a stop signal is transmitted to the microprocessor 504 via an output signal on the line 518 of the data input center 516. Thereafter, the field control signal 512 of the microprocessor 504 is varied to increase the resistive load applied to the alternator 42. The output signal 510 of the alternator provides a measurement of the speed at which the pedal 32 is moving as a function of the revolutions per minute (RPM) of the alternator 42. A second output signal on the line 514 of the power control board 506 transmits the RPM signal to the microprocessor 504. The microprocessor 504 continues to apply a resistive load to the alternator 42 via the power control board 506 until the RPM equals a predetermined minimum which, in the preferred embodiment, is equal to or less than 5 RPM.

In this embodiment, the microprocessor 504 can also vary the resistive force of the alternator 42 in response to the user's input to provide different exercise levels. A message center 522 includes an alpha-numeric display panel 524, shown in FIG. 16, that displays messages to prompt the user in selecting one of several pre-programmed exercise levels. In the preferred embodiment, there are twenty-four pre-programmed exercise levels, with level one being the least difficult and level 24 the most difficult. The data input center 516 includes a numeric key pad 526 and a pair of selection arrows 526, either of which can be employed by the user to choose one of the pre-programmed exercise levels. For example, the user can select an exercise level by entering the number, corresponding to the exercise level, on the numeric keypad 526 and thereafter depressing a start/enter key 526. Alternatively, the user can select the desired exercise level by using the selection arrows 526 to change the level displayed on the alpha-numeric display panel 524 and thereafter depressing the start/enter key 528 when the desired exercise level is displayed. The data input center 526 also includes a clear/pause key 530 which can be pressed by the user to clear or erase the data input before the start/enter key 528 is pressed. In addition, the exercise apparatus 10 includes a user-feedback apparatus that informs the user if the data entered are appropriate. In the preferred embodiment, the user feed-back apparatus is a speaker 532, shown in FIG. 15, that is operatively connected to the microprocessor 504. The speaker 532 generates two sounds, one of which signals an improper selection and the second of which signals a proper selection. For example, if the user enters a number between 1 and 24 in response to the exercise level prompt displayed on the alpha-numeric panel 524, the speaker 532 generates the correct-input sound. On the other hand, if the user enters an incorrect datum, such as the number 100 for an exercise level, the speaker 532 generates the incorrect-input sound thereby informing the user that the data input was improper. The alpha-numeric display panel 524 also displays a message that informs the user that the data input was improper. Once the user selects the desired appropriate exercise level, the microprocessor 504 transmits a field control signal on the line 512 that sets the resistive load applied to the alternator 42 to a level corresponding with the pre-programmed exercise level chosen by the user.

The message center 522 displays various types of information while the user is exercising on the apparatus 10. As shown in FIG. 16, the alpha-numeric display panel 522 preferably is divided into four sub-panels 534A–D, each of which is associated with specific types of information. Labels 536A–H and LED indicators 538A–H located above the sub-panels 534A–D indicate the type of information displayed in the sub-panels 538A–D. The first sub-panel 534A displays the time elapsed since the user began exercising on the exercise apparatus 10. The second sub-panel 534B displays the pace at which the user is exercising. The third sub-panel 534C displays either the exercise level chosen by the user or, as explained below, the heart rate of the user. The LED indicator 538C associated with the exercise level label 536C is illuminated when the level is displayed in the sub-panel 534C and the LED indicator 538D associated with the heart rate label 536D is illuminated when the sub-panel 534C displays the user's heart rate. The fourth sub-panel 534D displays four types of information: the calories per hour at which the user is currently exercising; the total calories that the user has actually expended during exercise; the distance, in miles or kilometers, that the user has "traveled" while exercising; and the power, in watts, that the user is currently generating. In the default mode of operation, the fourth sub-panel 534D scrolls among the four types of information. As each of the four types of information is displayed, the associated LED indicators 538E-H are individually illuminated, thereby identifying the information currently being displayed by the sub-panel 534D. A display lock key 540, located within the data input center 516, can be employed by the user to halt the scrolling display so that the sub-panel 534D continuously displays only one of the four information types. In addition, the user can lock the units of the power display in watts or in metabolic units ("mets"), or the user can change the units of the power display, to watts or mets or both, by depressing a watts/mets key 542 located within the data input center 516.

In the preferred embodiment of the invention, the exercise apparatus 10 also provides several pre-programmed exercise programs that are stored within and implemented by the microprocessor 504. The different exercise programs further promote an enjoyable exercise experience and enhance exercise efficiency. The alpha-numeric display panel 524 of the message center 522, together with a display panel 544, guide the user through the various exercise programs. Specifically, the alpha-numeric display panel 524 prompts the user to select among the various preprogrammed exercise programs and prompts the user to supply the data needed to implement the chosen exercise program. The display panel 544 displays a graphical image that represents the current exercise program. The simplest exercise program is a manual exercise program. In the manual exercise program the user simply chooses one of the twenty-four previously described exercise levels. In this case, the graphic image displayed by the display panel 544 is essentially flat and the different exercise levels are distinguished as vertically spaced-apart flat displays. A second exercise program, a so-called hill profile program, varies the effort required by the user in a pre-determined fashion which is designed to simulate movement along a series of hills. In implementing this program, the microprocessor 504 increases and decreases the resistive force of the alternator 42 thereby varying the amount of effort required by the user. The display panel 544 displays a series of vertical bars of varying heights that correspond to climbing up or down a series of hills. A portion 546 of the display panel 544 displays a single vertical bar whose height represents the user's current position on the displayed series of hills. A third exercise program, known as a random hill profile program, also varies the effort required by the user in a fashion which is designed to simulate movement along a series of hills. However, unlike the regular hill profile program, the random hill profile program provides a randomized sequence of hills so that the sequence varies from one exercise session to another. A detailed description of the random hill profile program and of the regular hill profile program can be found in U.S. Pat. No. 5,358,105, the entire disclosure of which is hereby incorporated by reference.

A fourth exercise program, known as a cross training program, urges the user to manipulate the pedal 32 in both the forward-stepping mode and the backward-stepping mode. When this program is selected by the user, the user begins moving the pedal 32 in one direction, for example, in the forward direction. After a predetermined period of time, the alpha-numeric display panel 544 prompts the user to prepare to reverse directions. Thereafter, the field control signal 512 from the microprocessor 504 is varied to effectively brake the motion of the pedal 56 and the arm 68. After the pedal 32 and the arm 110 stop, the alpha-numeric display panel 524 prompts the user to resume his workout. Thereafter, the user reverses directions and resumes his workout in the opposite direction.

Two exercise programs, a cardio program and a fat burning program, vary the resistive load of the alternator 42 as a function of the user's heart rate. When the cardio program is chosen, the microprocessor 504 varies the resistive load so that the user's heart rate is maintained at a value equivalent to 80% of a quantity equal to 220 minus the user's age. In the fat burning program, the resistive load is varied so that the user's heart rate is maintained at a value equivalent to 65% of a quantity equal to 220 minus the user's heart age. Consequently, when either of these programs is chosen, the alpha-numeric display panel 524 prompts the user to enter his age as one of the program parameters. Alternatively, the user can enter a desired heart rate. In addition, the exercise apparatus 10 includes a heart rate sensing device that measures the user's heart rate as he exercises. The heart rate sensing device consists of heart rate sensors 548 and 548' that can be mounted either on the moving arms 110 or a the fixed handrail. In the preferred embodiment, the sensors 548 and 548' are mounted on the moving arms 110. A set of output signal on a set of lines 550 and 550' corresponding to the user's heart rate is transmitted from the sensors 548 and 548' to a heart rate digital signal processing board 552. The processing board 552 then transmits a heart rate signal over a line 554 to the microprocessor 504. A detailed description of the sensors 548 and 548' and the heart rate digital signal processing board 552 can be found in U.S. Pat. Nos. 5,135,447 and 5,243,993, the entire disclosures of which are hereby incorporated by reference. In addition, the exercise apparatus 10 includes a telemetry receiver 556, shown in FIG. 15, that operates in an analogous fashion and transmits a telemetric heart rate signal over a line 558 to the microprocessor 504. The telemetry receiver 556 works in conjunction with a telemetry transmitter that is worn by the user. In the preferred embodiment, the telemetry transmitter is a telemetry strap worn by the user around the user's chest, although other types of transmitters are possible. Consequently, the exercise apparatus 10 can measure the user's heart rate through the telemetry receiver 556 if the user is not grasping the arm 110. Once the heart rate signal 554 or 558 is transmitted to the microprocessor 504, the resistive load of the alternator 508 is varied to maintain the user's heart rate at the calculated value.

In each of these exercise programs, the user provides data that determine the duration of the exercise program. The user can choose between two exercise goal types, a time goal type and a calories goal type. If the time goal type is chosen, the alpha-numeric display panel 524 prompts the user to enter the total time that he wants to exercise. Alternatively, if the calories goal type is chosen, the user enters the total number of calories that he wants to expend. The microprocessor 504 then implements the chosen exercise program for a period corresponding to the user's goal. If the user wants to stop exercising temporarily after the microprocessor 504 begins implementing the chosen exercise program, depressing the clear/pause key 530 effectively brakes the pedal 32 and the arm 110 without erasing or changing any of the current program parameters. The user can then resume the chosen exercise program by depressing the start/enter key 528. Alternatively, if the user wants to stop exercising altogether before the chosen exercise program has been completed, the user simply depresses the brake key 520 to brake the pedal 32 and the arm 110. Thereafter, the user can resume exercising by depressing the start/enter key 528. In addition, the user can stop exercising by ceasing to move the pedal 32. The user then can resume exercising by again moving the pedal 32.

The exercise apparatus 10 also includes a pace option. In all but the cardio program and the fat burning program, the default mode is defined such that the pace option is on and the microprocessor 504 varies the resistive load of the alternator 42 as a function of the user's pace. When the pace option is on, the magnitude of the RPM signal 514 received by the microprocessor 504 determines the percentage of time during which the field control signal 512 is enabled and thereby the resistive force of the alternator 42. In general, the instantaneous velocity as represented by the RPM signal 514 is compared to a predetermined value to determine if the resistive force of the alternator 42 should be increased or decreased. In the presently preferred embodiment, the predetermined value is a constant of 30 RPM. Alternatively, the predetermined value could vary as a function of the exercise level chosen by the user. Thus, in the presently preferred embodiment, if the RPM signal 514 indicates that the instantaneous velocity of the pulley 38 is greater than 30 RPM, the percentage of time that the field control signal 512 is enabled is increased according to Equation 1.

$$\text{field control duty cycle} = \text{field control duty cycle} + \frac{((|\text{instantaneous RPM} - 30|)/2)^2 * \text{field control duty cycle})}{256} \qquad \text{Equation 1}$$

where field duty cycle is a variable that represents the percentage of time that the field control signal 190 is enabled and where the instantaneous RPM represents the instantaneous value of the RPM signal 198.

On the other hand, in the presently preferred embodiment, if the RPM signal 198 indicates that the instantaneous velocity of the pulley 48 is less than 30 RPM, the percentage of time that the field control signal 190 is enabled is decreased according to Equation 2.

$$\text{field control duty cycle} = \text{field control duty cycle} - \frac{((|\text{instantaneous RPM} - 30|)/2)^2 * \text{field control duty cycle})}{256} \qquad \text{Equation 2}$$

where field duty cycle is a variable that represents the percentage of time that the field control signal 190 is enabled and where the instantaneous RPM represents the instantaneous value of the RPM signal 198.

Moreover, once the user chooses an exercise level, the initial percentage of time that the field control signal 190 is enabled is pre-programmed as a function of the chosen exercise level as described in U.S. Pat. No. 6,099,439.

The preferred embodiment of the exercise apparatus 10 further includes a communications board 560 that links the microprocessor 504 to a central computer 562, as shown in FIG. 15. Once the user has entered the preferred exercise program and associated parameters, the program and parameters can be saved in the central computer 562 via the communications board 560. Thus, during subsequent exercise sessions, the user can retrieve the saved program and parameters and can begin exercising without re-entering data. In addition, at the conclusion of an exercise session, the user's heart rate, distance traveled, and total calories expended can be saved in the central computer 562 for future reference.

In using the apparatus 10, the user begins his exercise session by first stepping on the pedal 32 which, as previously explained, is heavily damped due to the at-rest resistive force of the alternator 42. Once the user depresses the start/enter key 528, the alpha-numeric display panel 524 of the message center 522 prompts the user to enter the required information and to select among the various programs. First, the user is prompted to enter the user's weight. The alpha-numeric display panel 524, in conjunction with the display panel 544, then lists the exercise programs and prompts the user to select a program. Once a program is chosen, the alpha-numeric display panel 524 then prompts the user to provide program-specific information. For example, if the user has chosen the cardio program, the alpha-numeric display panel 524 prompts the user to enter the user's age. After the user has entered all the program-specific information such as age, weight and height, the user is prompted to specify the goal type (time or calories), to specify the desired exercise duration in either total time or total calories, and to choose one of the twenty-four exercise levels. Once the user has entered all the required parameters, the microprocessor 504 implements the selected exercise program based on the information provided by the user. When the user then operates the pedal 32 in the previously described manner, the pedal 32 moves along the elliptical pathway 64 in a manner that simulates a natural heel to toe flexure that minimizes or eliminates stresses due to unnatural foot flexure. If the user employs the moving arm 110, the exercise apparatus 10 exercises the user's upper body concurrently with the user's lower body. Alternatively, the user can concentrate his exercise session on his lower body by disconnecting the arm handles 110 from the rocker 30 as described below The exercise apparatus 10 thus provides a wide variety of exercise programs that can be tailored to the specific needs and desires of individual users, and consequently, enhances exercise efficiency and promotes a pleasurable exercise experience.

IX. Arm Handle Disconnect Mechanisms

Figure 17:
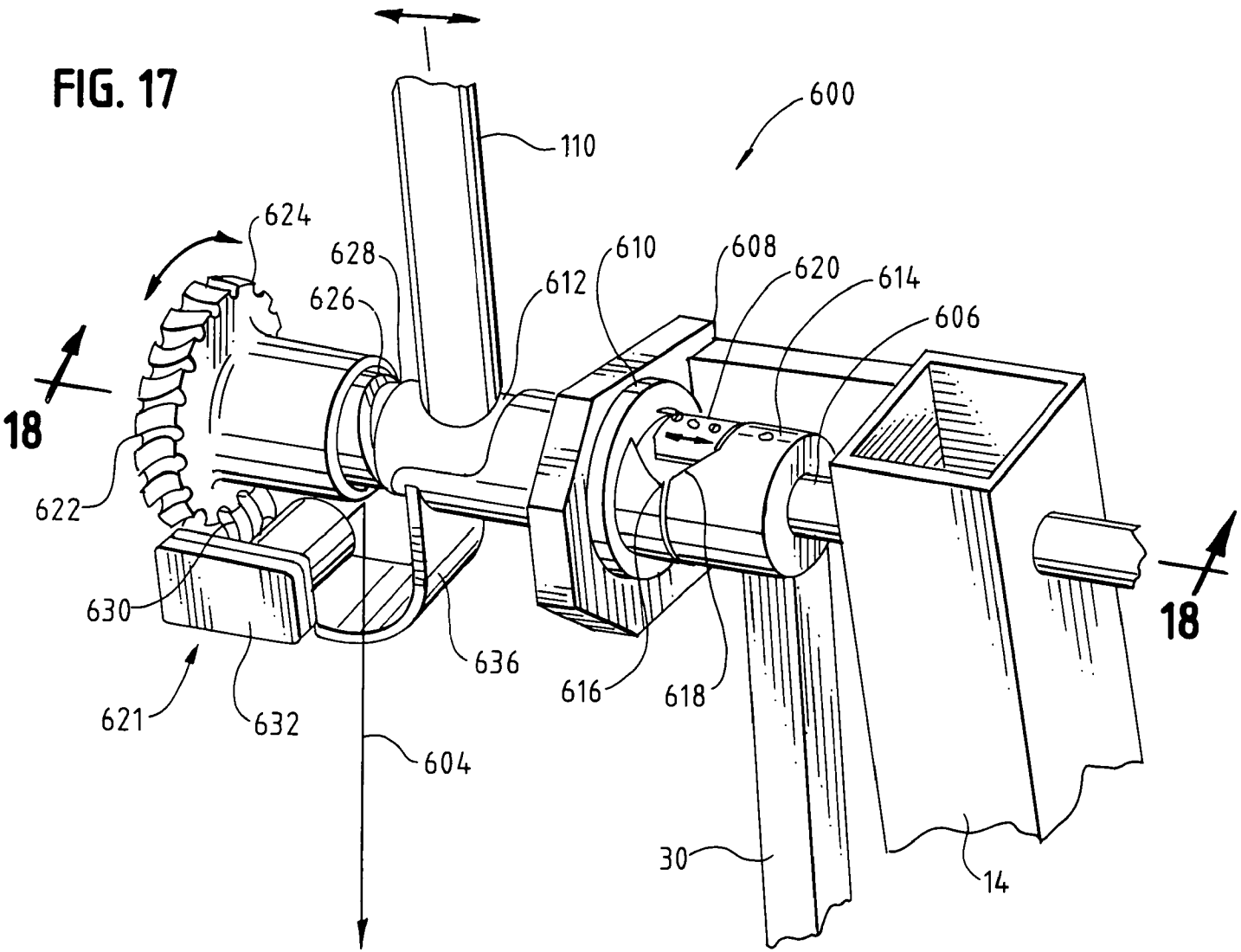
FIG. 17 is a perspective side view of a first arm handle disconnect mechanism according to the invention.
Figure 18:
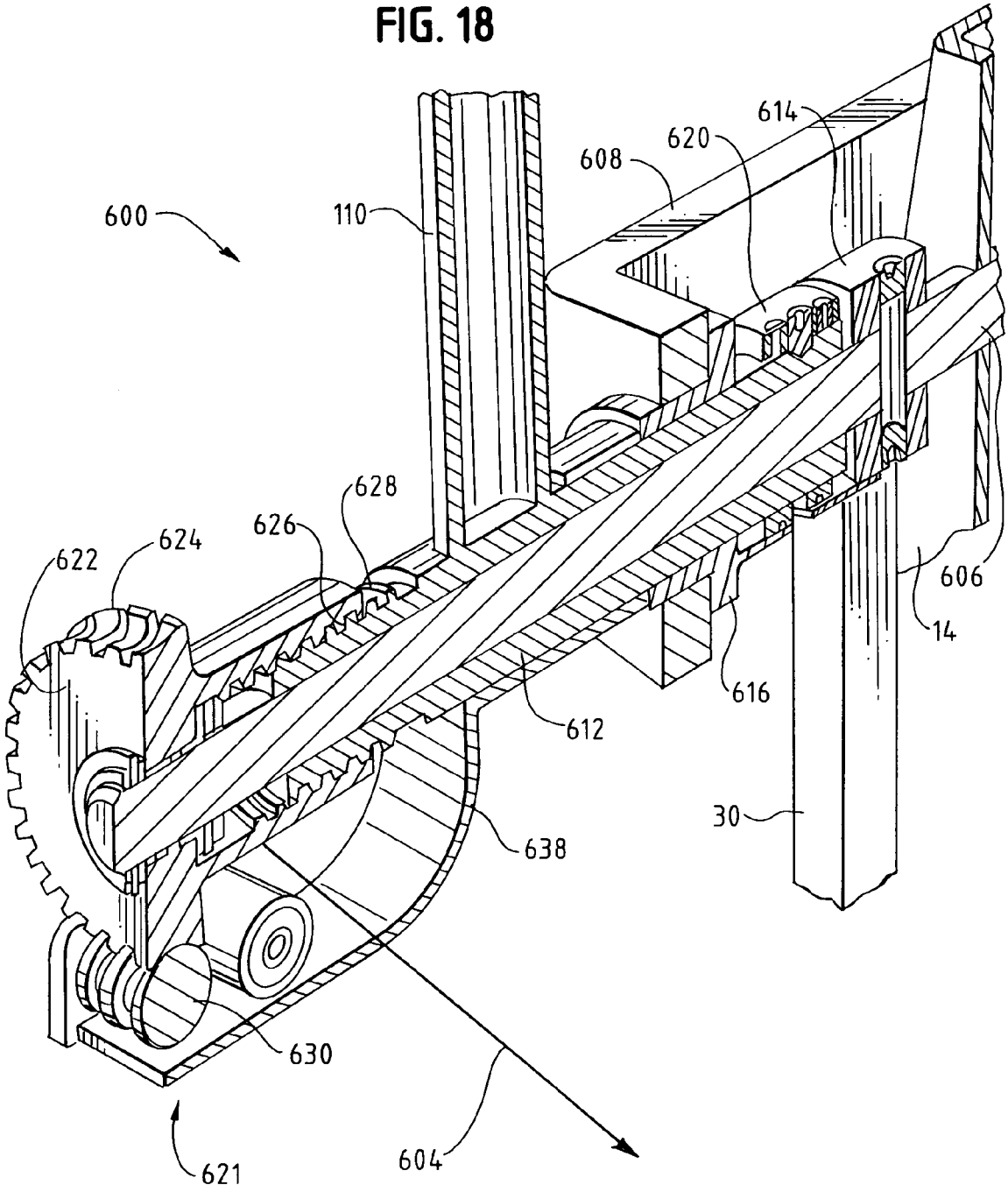
FIG. 18 is a sectioned perspective side view of the first arm handle disconnect mechanism taken along lines 17—17 of FIG. 17.

FIGS. 17 and 18 illustrate a first embodiment of a coupling mechanism 600 for selectively connecting and disconnecting the arm handle 110 to the rocker link 30. In many elliptical exercise machines including the type 10 shown in FIGS. 1–4 and 6A–H, the arm handles 110 are permanently connected to the rocker links 30, or to pedal levers in the case of the types of machines shown in U.S. Pat.

No. 6,099,439, so that the handles move in synchronism with the pedals 32. However, for those users who do not desire the upper body workout provided by the arm handles 110, it is necessary for the users to find another portion of the machine 10 to hold on to while operating the apparatus 10 and, moreover, the moving handles 110 can be distracting. The mechanism 600 allows the user to disconnect the arm handles 110 from the rocker links 30 and to lock the arm handles to the frame 12 thus providing a secure and convenient handhold while performing a stepping exercise. In the preferred embodiment of the invention, the coupling mechanism 600 can be operated by a using a arm handle disconnect key 602 on the console 502 shown in FIG. 16. An actuation signal is then transmitted from the data input center 516 via the line 518 to the microprocessor 504 which in turn transmits a disconnect or connect signal to the coupling mechanism 600 over a line 604 as shown in FIG. 17. This permits the user to automatically engage or disengage the arm handles 110 using the console 502. Alternatively, it might be desirable, for example in less expensive machines, to provide a manually operated coupling mechanism for disengaging the arm handles 110 from the rocker links 30 or the pedals 32.

In the first embodiment of the coupling mechanism 600, a shaft 606 extends through the vertical support member 14 to provide support for both the rocker links 30 and the arm handles 110. For convenience of description, FIGS. 17 and 18 illustrate the coupling mechanism 600 used on the left side of the apparatus 10 and it should be understood that a similar coupling mechanism would be used to connect the arm handle 110 to the rocker link 30 on the right side of the machine 10. A bracket 608, welded or otherwise secured to the vertical support 14, is used to secure a frame hub 610 to the frame 12. Mounted for rotation concentric with the shaft 606 is a connecting member or sleeve 612 to which the arm handle 110 is secured. A shaft hub 614 is secured to the shaft 606 and the rocker link 30. Both the frame hub 610 and the shaft hub 612 are configured with beveled detent receptacles, 616 and 618 respectively, for receiving a detent or stop 620. The stop 620 is securely mounted to the connecting member 612 by fasteners or other methods. An actuator 621 including a worm gear 622 having a set of external treads 624 is mounted for rotation on the shaft 606 and includes a set of internal treads 626 that are engaged with a set of external threads 628 on the end of the connecting member 612. Engaged with the worm gear threads 624 is a worm 630 that in turn is connected through a gear box 632 to a motor 634. The motor 634, the gearbox 632 and the worm 630 of the actuator 621 are mounted on a support 636. As indicated in FIG. 15, the motor is controlled by signals transmitted from the microprocessor 504 over the line 604.

In operation, the coupling mechanism 604 responds to a disconnect signal over line 604 to disconnect the arm handle 110 from rotation with the rocker link 30 by causing the motor 634 to rotate the worm gear 622 thereby resulting in the connecting member 612 moving longitudinally to the left. This causes the stop 620 move from its engagement with the beveled portion 618 of the frame hub 614 to the left along the shaft 606 where it engages with the beveled portion 616 of the frame hub 610. When the stop 620 is engaged with the beveled portion, the arm handle 110 is effectively locked to the frame 10 preventing rotation or movement of the handle 110. Similarly, a connect signal on the line 604 will cause the motor 634 to revolve in the other direction resulting in the stop 620 engaging the shaft hub 614 thus reconnecting the arm handle 110 to the rocker link 30. In the preferred embodiment of the coupling mechanism 600, the bevels 616 and 618 are shaped so that the rocker line 30 is free to rotate on the shaft 606 as the pedal lever 34 moves back and forth when the stop 620 is engaged with the frame hub 610 and at the same time are long enough to guide the stop 620 into both hubs 610 and 614.

A simplified, manually operated version of the coupling mechanism 600 can be achieved by removing actuator 621 including the motor 634, the gear box 632 and the worm 630 and replacing the threads 624 of the worm gear 622 with a smooth surface. The user then can simply use the worm gears 622 as knobs to disconnect the arm handles 110 from the rocker links 30 and lock them to the frame 10.

Figure 19:
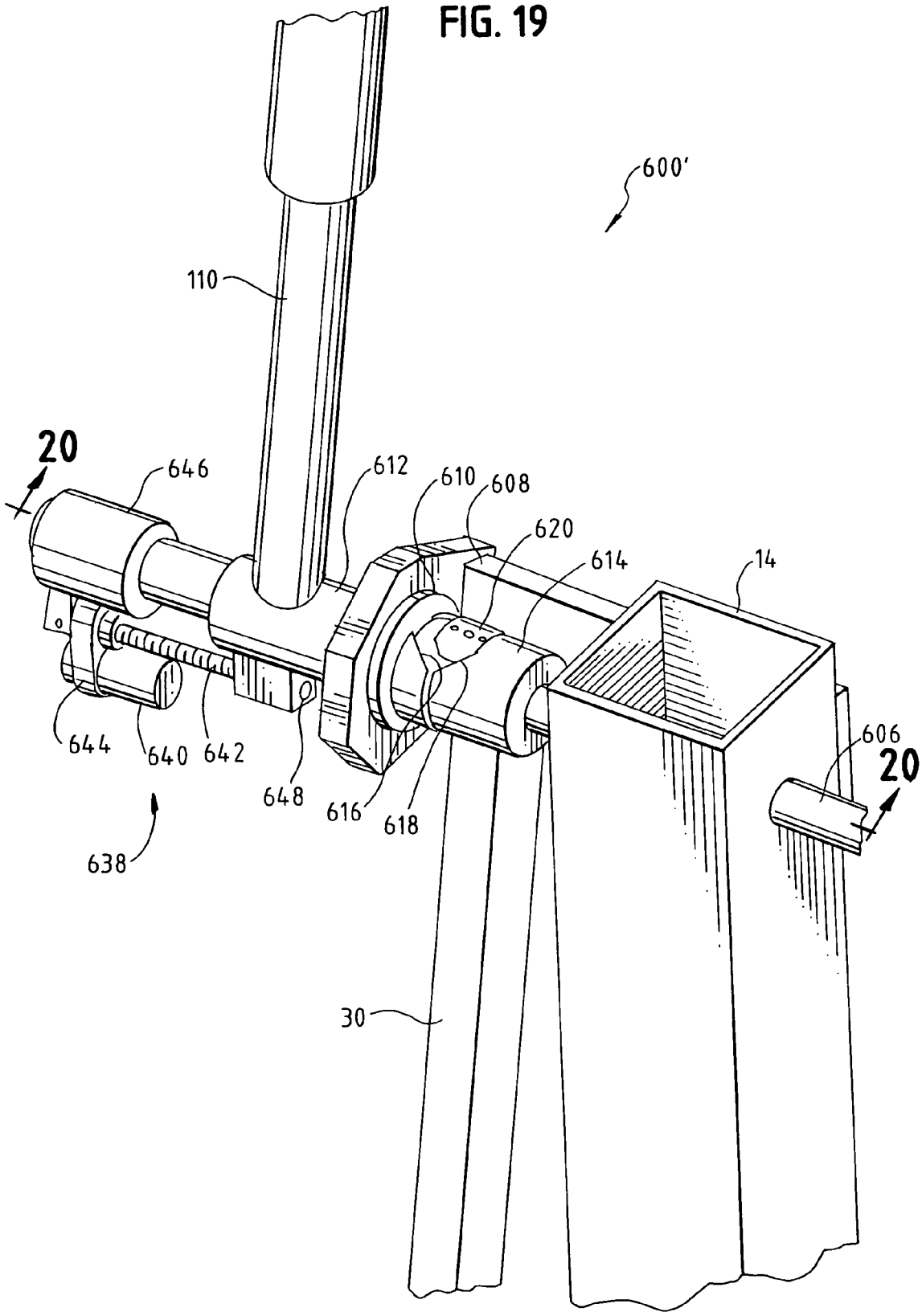
FIG. 19 is a perspective side view of a second arm handle disconnect mechanism according to the invention.
Figure 20:
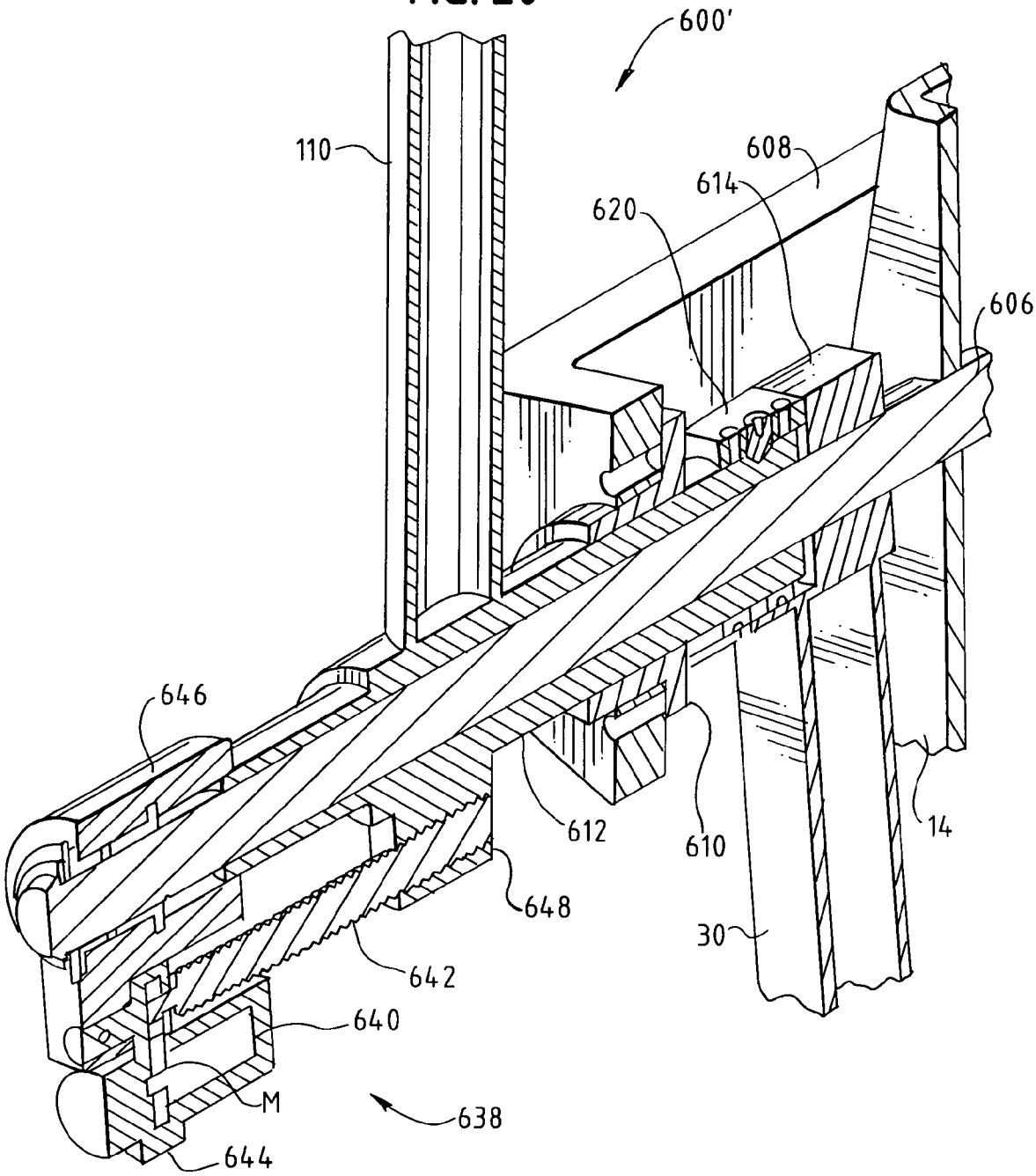
FIG. 20 is a sectioned perspective side view of the second arm handle disconnect mechanism taken along lines 20—20 of FIG. 19.

FIGS. 19 and 20 illustrate a second embodiment of a coupling mechanism 600' for selectively connecting and disconnecting the arm handle 110 to the rocker link 30. The components of the coupling mechanism 600' that are similar to the components of the coupling mechanism 600 shown in FIGS. 17 and 18 are identified by the same reference numerals. In this mechanism 600', an actuator mechanism 638 that includes a motor 640 and a rotatable connecting or actuation rod 642 connected to the motor 640 by a transmission 644 is effective to move the connecting member 612 to disconnect the arm handle 110 from the rocker link 30 and to lock it to the frame hub 610 in response to a signal on line 604. The actuator mechanism 638 is secured to the shaft 606 by a mounting housing 646 that is secured but free to rotate on the end of the shaft 606. In this embodiment, the connecting rod 642 is inserted into a treaded hole 648 in a projection 650 extending downwardly from the connecting member 612. The motor 640 rotates the connecting rod 642 thereby moving the connecting member 612 linearly along the shaft 606.

The coupling mechanisms 600 and 600' represent preferred embodiments of a mechanism to disconnect the arm handles 110 from the rocker arms 30 in an elliptical step exercise apparatus. However, it should be noted that variations on the above described mechanical arrangements can be substituted for the mechanism shown to provide a method for selectively connecting the arm handles 110 to the rocker links 30 and the frame 10. For example, other types of mechanical connectors such as retractable pins can be used instead of the moveable detent mechanism shown in FIGS. 17–20. Or, for instance, the shaft 606 can be made rotatable in the vertical support member 14 where the shaft hub 614 is fixed for rotation with the shaft 14. In addition, a linear member can be used rather than the tubular connecting member 612 shown in the drawings. Also, other types of actuating mechanisms such as linear actuators or even hydraulic actuators can be substituted for the actuators 621 and 638 shown in FIGS. 17–19 to achieve an automatic or remote disconnect mechanism. Moreover, remotely operated disconnect mechanisms of the type 600 and 600' can be used to disconnect arm handles from pedal motion in other types of elliptical step exercise apparatus such as the one shown in U.S. Pat. No. 6,099,439.

X. Stride Length Adjustment Mechanisms

The ability to adjust the stride length in an elliptical step exercise apparatus is desirable for a number of reasons. First, people, especially people with different physical characteristics such as height, tend to have different stride lengths when walking or running. Secondly, the length of an individuals stride generally increases as the individual increases his walking or running speed. As suggested in U.S. Pat. Nos. 5,743,834 and 6,027,431, there are a number of mechanisms for changing the geometry of an elliptical step mechanism in order to vary the path the foot follows in this type of apparatus.

With reference to FIGS. 21–25, as well as the control system shown in FIGS. 15–16, a mechanism is described whereby stride length can be automatically modified in the type of machine 10 shown in FIGS. 1–4 to take into account the characteristics of the user or the exercise being performed.

Figure 21:
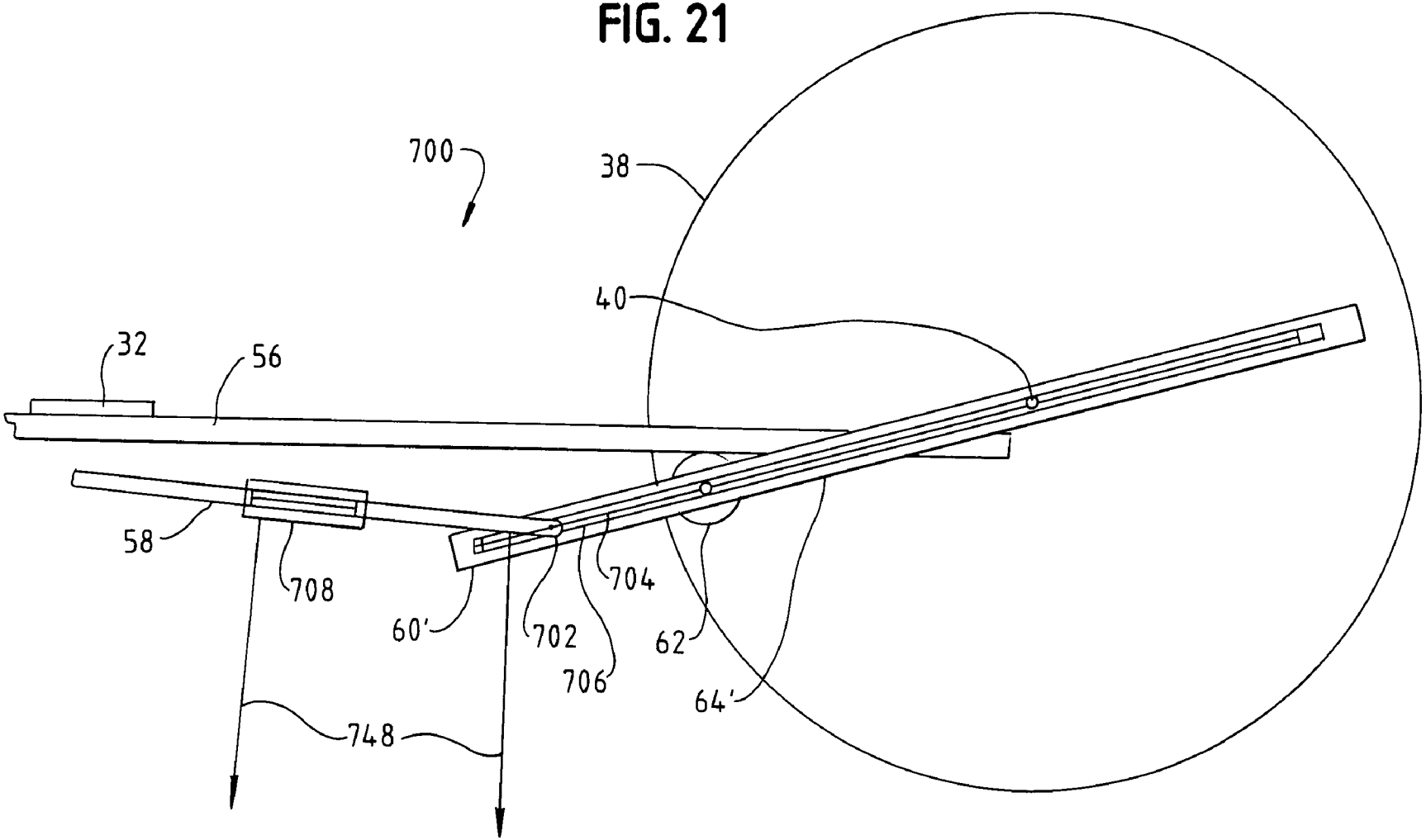
FIGS. 21–25 are side views of pedal actuation assemblies for use with the exercise apparatus of the general type shown FIGS. 1–4 according to the invention.

As illustrated in FIG. 21, a pedal actuation assembly 700 is provided to modify stride length. Elements of the pedal actuation assembly 700 in FIG. 21 that correspond to the pedal actuation assembly 34 in FIGS. 1–4 have like reference numerals. In this case, an extension arm 60', which corresponds in function to the extension arm 60 in the assembly 34, extends directly from a crank 64'. Because the extension arm 60' extends to and beyond the pivot axle 40, it is possible to move a pivotal connection point 702 of the stroke link 58 along the extension arm 60', by a mechanism or actuator depicted at 704 in a slot 706, and along the crank 64' to the pivot axle 40. When the connection point 702 is aligned with the pivot axle 40 the pedal lever 56 will not move in a longitudinal direction thus resulting in a purely vertical movement of the foot pedal 32. If the pivot point 702 is moved past the axle 40 the foot pedal 32 move in a longitudinal direction opposite of the arm handles 110 shown in FIGS. 6A–H. As a result, the pedal actuation assembly 700 provides added flexibility to an elliptical step apparatus. An alternate method of providing a stride adjustment capability in the pedal actuation assembly 700 is to fit an actuator 706 to the stroke link 58.

Figure 22:
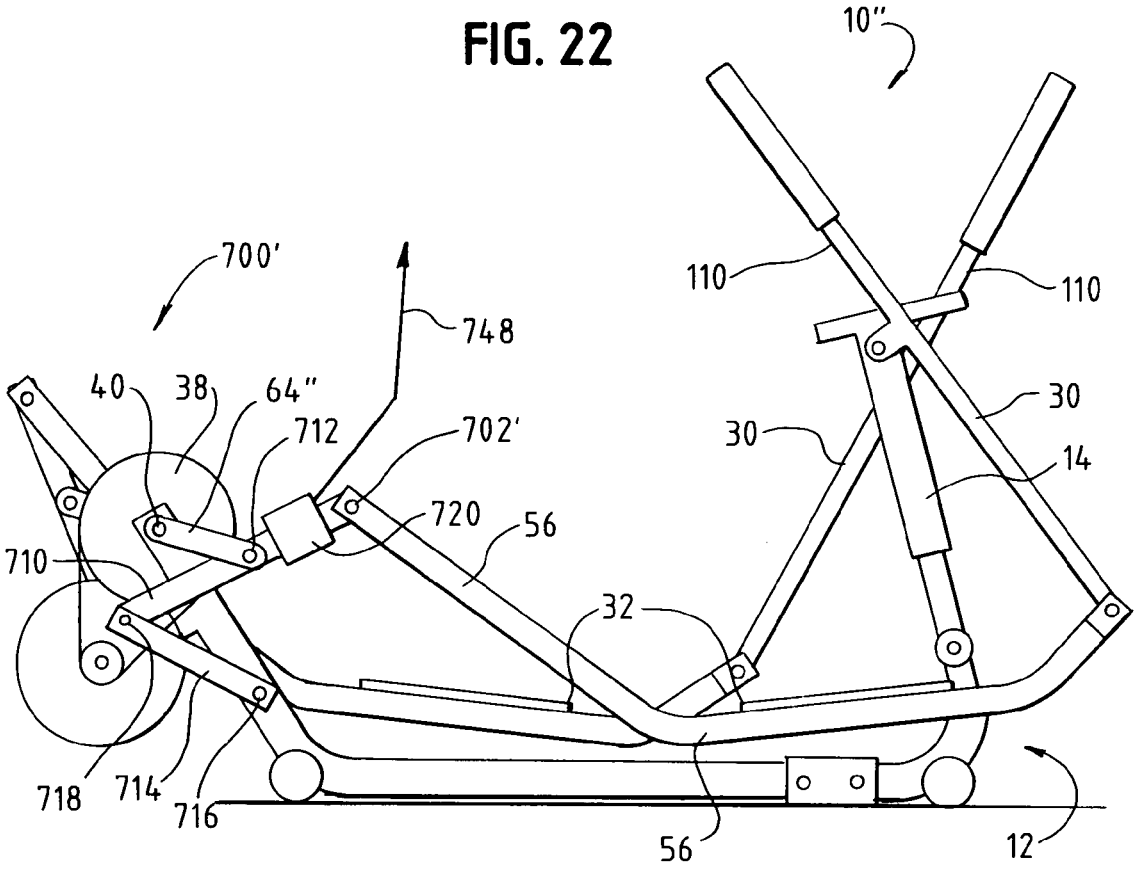

FIG. 22 illustrates another elliptical step apparatus 10" having a modified pedal actuation assembly 700'. Included in the pedal actuation assembly 700' is a first link 710 pivotally connected to the pedal lever 56 at a pivot point 702' and to a crank 64" at a pivot point 712. A second link 714 is pivotally connected at one end to the frame 12 at a pivot 714 and at its other end to the first link 710 at a pivot point 718. A detailed description of the operation of this type of actuation assembly 700' is provided in U.S. Pat. No. 5,895,339. Stride adjustment is provided by a mechanism such as an actuator 720 fitted on the first link 710. By adjusting the mechanism 720 to increase the length of the first link 710, the length of the horizontal movement of the pedals 32 can be increased.

Figure 23:
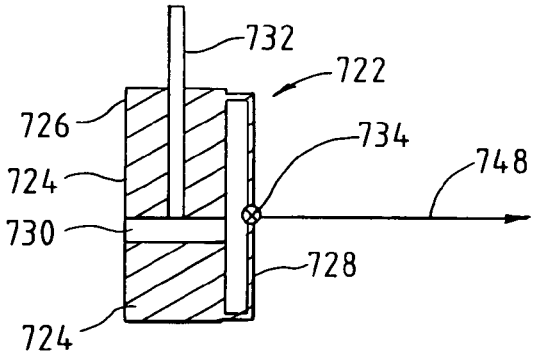

In addition to manually operable mechanisms such as a pin and hole arrangement, there are a number of electorally operated actuators can used for the actuators 704, 708 and 720. Linear actuators or actuators of the general type 621 and 638 are examples of other types of actuators that can be used. FIGS. 22–23 provide additional examples of such actuators.

FIG. 23 is a schematic view of a first actuator 722 that can be mounted for example on the extension arm 60' or the crank 64' of the pedal actuation assembly 700 of FIG. 21. In this actuator 722, a hydraulic fluid indicated at 724 contained in a cylinder 726 flows through a line 728 to control the position of a piston 730 in the piston cylinder 726 which in turn is connected to the extension arm 60' or the crank 64' by a piston rod 732. Flow of the fluid 724 is regulated by a valve 734. In the preferred embodiment of this actuator 722, the valve is opened when the extension arm 60' or the crank 64' is under tension and closed when they are under compression. This will serve to lengthen the extension arm 60' or the crank 64' thereby increasing stride length. Reducing the length of the extension arm 60' or the crank 64' is accomplished by reversing the process. It should be noted that variations on this actuator 722 can be used such as replacing the hydraulic fluid 724 with a pheonetic magnetic fluid where the fluid is controlled by a flow channel in the piston 730. One advantage of this actuator 722 is that it does not require a source of outside energy to move the piston 730 but only enough energy to operate the valve 734. This type of actuator can be especially useful in self powered apparatus such as the elliptical step apparatus 10 shown in FIGS. 1–4 where power is only obtained from the alternator 42 when a user is moving the pedals 32.

Figure 24:
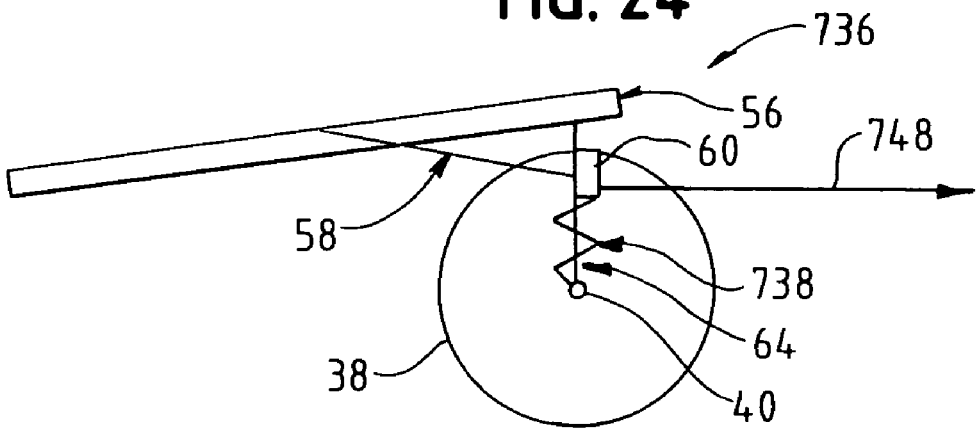

FIG. 24 is a schematic view of a second actuator 736 mounted for example on the extension arm 60 or the crank 64 of the pedal actuation assembly 700. In this embodiment, a spring 738 is attached to extension arm 60 and to the end the crank 64. To increase stride length, a switch or latch (not shown) is opened and the point of attachment of the extension arm 60 on the crank 64 moves outwardly due to centrifugal force as the pulley 38 rotates. To decrease stride length, the switch is opened when pulley 38 is not rotating or rotating very slowly and the spring will retract the extension arm 60 towards the pivot axle 40. As with the actuator 722, this actuator 736 can be used on a self powered machine such as the elliptical step apparatus 10.

Figure 25:
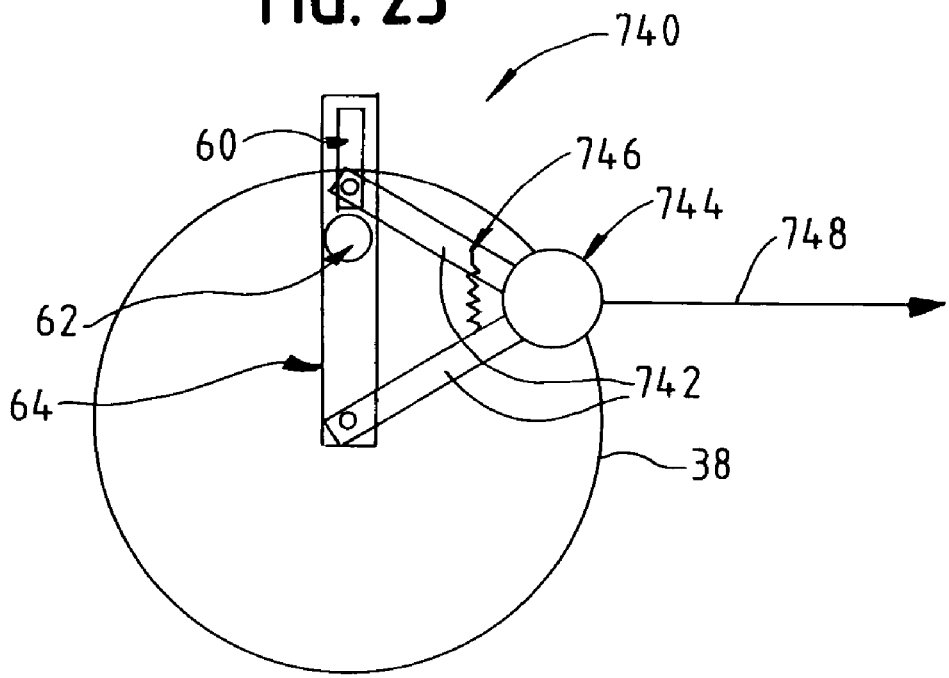

FIG. 25 is a schematic view of a third actuator 740 that can be used for example on the pedal actuation assembly 700. In this embodiment a pair of extension links 742 are pivotally connected to the extension arm 60 and the crank 64. A magnetic fluid control disk 744 controls the separation of the extension links 740 and therefore the connection point 702 of the extension arm 60 on the crank 64. As with the actuators 722, centrifugal force will move the extension arm 60 outwardly along the crank 64 when the pulley 38 rotates on the axle 40 and the fluid disk 744 will then hold the extension links 742 and hence the extension arm 60 in place. Stride length can then be shortened when the pulley 38 is stopped and the fluid disk 744 permits a spring 746 to move the extension links 742 toward each other. As with the actuators 722 and 736, this actuator 740 can be used on the self powered machine 10.

In these embodiments of the invention, stride length can be varied automatically as a function of exercise or apparatus parameters. Specifically, the control system 500 and the console 502 of FIGS. 15 and 16 can be used to control stride length in the elliptical step exercise apparatus 10 either manually or as a function of a user or operating parameter. In FIG. 15 the pedal actuation assembly generally represented within the dashed lines 34 can be implemented by a number of mechanisms that provide for stride adjustment such as the assemblies 700, 700', 722, 736 and 740. As shown in FIG. 15, a line 748 connects the microprocessor 504 to the electronically controlled actuator elements 704, 708, 720, 734 or 744. Stride length can then be varied by the user via a manual stride length key 750 which is connected to the microprocessor 504 via the data input center 516. Alternatively, the user can have stride length automatically varied by using a stride length auto key that is also connected to the microprocessor 504 via the data input center 516. In the preferred embodiment, the microprocessor is programed to respond to the speed signal on line 514 to increase the stride length as the speed of the pedals 32 increases. Pedal direction, as indicated by the speed signal can also be used to vary stride length. For example, if the microprocessor 504 determines that the user is stepping backward on the pedals 32, the stride length can be reduced since an individuals stride is usually shorter when stepping backward. Additionally, the microprocessor 504 can be programmed to vary stride length a function of other parameters such as resistive force generated by the alternator 42; heart rate measured by the senors 548 and 548'; and user data such as weight and height entered into the console 502.

We claim:

1. An exercise apparatus comprising:

a frame;

a pedal lever;

a pedal, having a toe portion and a heel portion, secured to said pedal lever;

a shaft secured to said frame;

a guide mechanism including a rocker link, pivotally coupled at a first end to a first portion of said pedal lever and connected at a second end to said shaft, effective to guide a first portion of said pedal lever in a generally horizontal reciprocating motion;

a pivot axle supported by said frame;

a crank rotationally connected to said pivot axle;

an attachment assembly operatively connected to said crank and a second portion of said pedal lever wherein said attachment assembly is effective to move said second portion of said pedal lever in a horizontal and vertical path as said crank rotates about said pivot axle resulting in said pedal moving in a generally elliptical path;

an arm handle mounted on said shaft; and a coupling mechanism, operatively connected to said rocker link and said arm handle, for permitting a user selectively to lock said arm handle to prevent said rotation on said shaft or to couple said arm handle to said rocker link for rotation therewith.

2. The apparatus of claim 1 wherein said coupling mechanism includes a frame hub secured to said frame and a shaft hub secured to said rocker link and secured to said shaft for rotation therewith wherein said arm handle is selectively engaged with either said frame hub or said shaft hub.

3. The apparatus of claim 2 wherein said coupling mechanism includes a connecting member concentric with and rotatable on said shaft and said arm handle is secured far rotation with said connecting member and wherein said connecting member includes a stop member configured for alternative engagement with said shaft hub and said frame hub.

4. The apparatus of claim 3 wherein said coupling mechanism includes an engagement mechanism that permits the user to move said connecting member along said shaft so that said stop member is selectively engaged with said shaft hub or said frame hub.

5. The apparatus of claim 4 wherein said engagement mechanism includes a handwheel connected to said connecting member and threadably engaged with said shaft.

6. The apparatus of claim 4 wherein the apparatus includes a user input system and a control system operatively connected to said user input system and wherein said engagement mechanism includes an actuator mechanism responsive to said user input system to move said connecting member longitudinally along said shaft.

7. The apparatus of claim 6 wherein said actuator mechanism includes a worm gear threadably engaged with said shaft and a motor, operatively connected to said control system and said worm gear, wherein said motor is effective to rotate said worm gear thereby moving said connecting member along said shaft.

8. The apparatus of claim 7 wherein said actuator mechanism includes a motorsupport member secured to said connecting member and said motor.

9. The apparatus of claim 6 wherein said actuator mechanism includes an actuator support member mounted on said shaft and secured from longitudinal movement on said shaft; an actuation member threadably engaged with said connecting member; and an actuation motor operatively connected to said control system and secured to said actuator support member and engaged with said actuation member effective rotate said actuation member so as to move said connecting member longitudinally along said shaft.

10. An exercise apparatus comprising:

a frame;

a pedal lever;

a pedal, having a toe portion and a heel portion, secured to said pedal lever;

a guide mechanism including a rocker link, pivotally coupled at a first end to a first portion of said pedal lever and pivotally connected at a second end to said frame, effective to guide a first portion of said pedal lever in a generally horizontal reciprocating motion;

a pivot axle supported by said frame;

a crank rotationally connected to said pivot axle;

an attachment assembly operatively connected to said crank and a second portion of said pedal lever wherein said attachment assembly as effective to move said second portion of said pedal lever in a horizontal and vertical path as said crank rotates about said pivot axle resulting in said pedal moving in a generally elliptical path;

a control system;

a user input system, operatively connected to said control system, to permit a user to input a disconnect signal into said control system;

an arm handle pivotally mounted on said frame; and a coupling mechanism, including an actuator assembly operatively connected to said control system, for connecting said arm handle to said rocker link for movement therewith and, in response to said disconnect signal, disconnecting said arm handle from said rocker link and locking said arm handle to prevent movement of said arm handle with respect to said frame.

11. The apparatus of claim 10 wherein said actuator assembly includes a motor operatively connected to said control system and to a worm gear for selectively engaging said arm handle with said rocker link.

12. The apparatus of claim 11 wherein said coupling mechanism includes a shaft secured to said frame, a frame hub secured to said frame and a shaft hub secured to said rocker link, a connecting member concentric with and rotatable on said shaft and said arm handle is secured for rotation with said connecting member and wherein said connecting member includes a stop member configured for alternative engagement with said shaft hub and said frame hub and wherein said worm gear is threadably engaged with said shaft and wherein said motor is effective to rotate said worm gear thereby moving said connecting member along said shaft.

13. The apparatus of claim 10 wherein said actuator assembly includes an actuator motor operatively connected to said control system for selectively engaging said arm handle with said rocker link.

14. The apparatus of claim 13 wherein said coupling mechanism includes a shaft secured to said frame, a frame hub secured to said frame and a shaft hub secured to said rocker link; a connecting member concentric with said shaft and wherein said arm handle is secured for rotation with said connecting member and wherein said connecting member includes a stop member configured for alternative engagement with said shaft hub and said frame hub and wherein said actuator assembly includes an actuator member connected to said motor arid wherein said motor is mounted on said shaft and the actuator member is connected to said connecting member thereby being effective to move said connecting member longitudinally along said shaft.

* * * * *